United States Patent [19]

Kindig et al.

[11] Patent Number: 4,695,290

[45] Date of Patent: Sep. 22, 1987

[54] INTEGRATED COAL CLEANING PROCESS WITH MIXED ACID REGENERATION

[75] Inventors: James K. Kindig, Boulder; James E. Reynolds, Golden, both of Colo.

[73] Assignee: Integrated Carbons Corporation, Tulsa, Okla.

[21] Appl. No.: 748,236

[22] Filed: Jun. 24, 1985

Related U.S. Application Data

[63] Continuation-in-part of Ser. No. 517,338, Jul. 26, 1983, abandoned, and a continuation-in-part of Ser. No. 517,339, Jul. 26, 1983, abandoned, and a continuation-in-part of Ser. No. 517,340, Jul. 26, 1983, abandoned, and a continuation-in-part of Ser. No. 517,362, Jul. 26, 1983, abandoned.

[51] Int. Cl.[4] ..... C10L 9/02; C10L 9/06

[52] U.S. Cl. ..... 44/1 S R; 201/17; 423/460

[58] Field of Search ..... 44/1 S R, 1 R; 201/17; 423/481, 483, 460, 484

[56] References Cited

U.S. PATENT DOCUMENTS

| | | | |
|---|---|---|---|
| 887,145 | 5/1908 | Stoner | 201/17 |
| 1,923,324 | 8/1933 | Mitchell | 23/154 |
| 2,205,410 | 6/1940 | Howard | 196/28 |

(List continued on next page.)

FOREIGN PATENT DOCUMENTS

| | | |
|---|---|---|
| 760896 | 6/1967 | Canada . |
| 0016624 | 3/1980 | European Pat. Off. . |
| 1036233 | 11/1955 | Fed. Rep. of Germany . |

OTHER PUBLICATIONS

Leonard, et al., *Coal Preparation,* 4th ed, 1979, pp. 1-6 to 1-8, 1-34 to 1-36, 4-46, 7-26 to 7-28.

American Soc. for Testing and Material, "1980 *Annual Book of ASTM Standards*", part 26, Grindability of Coal by the Hardgrove-Machine Method", pp. 229-235.

Campbell, et al. *Coalas a Source of Electrode Carbon in Aluminum Production,* Bureau of Mines Report of Investigations 5191.

Blake, et al., Utilization of Waste Fluosilicic Acid, Bureau of Mines Report of Investigations 7502.

*Primary Examiner*—Carl F. Dees

*Attorney, Agent, or Firm*—Sheridan, Ross & McIntosh

[57] ABSTRACT

The present invention provides processes for the continuous removal of contaminants from coal to produce a clean purified fuel. The processes generally comprise producing a clean coal product having a mineral matter content of less than about 5 percent by weight from coal and coal derivatives by leaching feed coal crushed or sized to less than about 1 inch with a mixture of hydrochloric and hydrofluoric acids comprising less than about 70 weight percent HF and less than about 38 weight percent HCl at atmospheric pressure and at a temperature below the boiling point of the acid mixture. One embodiment of the present invention provides a process for producing a coal product with 5 percent ash content or less comprising comminuting raw coal or other coal-derived feed material to a size less than about 10 mm; leaching the comminuted coal with a mixture of HF and HCl comprising less than about 70 percent by weight HF and less than 38 percent by weight HCl at atmospheric pressure and a temperature below boiling, preferably ambient; separating the leached residue from the spent acid; washing the leached residue substantially free of spent acids and dissolved solids; separating pyrite from the coal by physical means; reducing halogens on the coal to an acceptable level by thermal treatment; and regenerating the mixture of HF and HCl by dual pyrohydrolysis and sulfation of the spent acids to recover substantially all of the fluorine value except for that reporting to waste as $MgF_2$, either as HF or as volatile fluorides which are recycled. Another embodiment of the invention provides processes for producing HF, HCl, and mixtures thereof from complex aqueous streams containing at least two metal halide salts one of which will pyrohydrolyze in the presence of water vapor to form hydrogen halide and the metal oxide and one of which will not, but will in the presence of water vapor, $SO_2$ and oxygen form hydrogen halide and metal sulfate.

40 Claims, 2 Drawing Figures

U.S. PATENT DOCUMENTS

| | | | |
|---|---|---|---|
| 2,320,629 | 6/1943 | Matuszak | 196/10 |
| 2,419,558 | 4/1947 | Gibson | 23/153 |
| 2,458,044 | 1/1949 | Alexander | 260/683.4 |
| 2,486,485 | 11/1949 | Latchum, Jr. | 23/154 |
| 2,773,736 | 12/1956 | Hollingsworth | 23/14.5 |
| 2,808,369 | 10/1957 | Hickey | 202/25 |
| 3,107,148 | 10/1963 | Brooks | 23/153 |
| 3,157,469 | 11/1964 | Tufts | 23/153 |
| 3,195,979 | 7/1965 | Burkert et al. | 23/153 |
| 3,203,892 | 8/1965 | Kimberlin et al. | 208/252 |
| 3,218,127 | 11/1965 | Houston | 23/153 |
| 3,218,128 | 11/1965 | Klem | 23/153 |
| 3,218,129 | 11/1965 | Barker et al. | 23/153 |
| 3,257,167 | 6/1966 | Mohr et al. | 23/153 |
| 3,280,211 | 10/1966 | McCaulay | 260/683.48 |
| 3,314,755 | 4/1967 | Claus | 23/153 |
| 3,318,124 | 11/1965 | Oakley, Jr. et al. | 23/153 |
| 3,455,650 | 7/1969 | Conte et al. | 23/153 |
| 3,472,624 | 10/1969 | Ridley | 209/9 |
| 3,484,196 | 12/1969 | Cohen et al. | 23/123 |
| 3,511,603 | 5/1970 | Yaws | 23/153 |
| 3,537,817 | 11/1970 | Bachelard | 23/153 |
| 3,551,098 | 12/1970 | Flemmert | 23/88 |
| 3,645,681 | 2/1972 | Bachelard | 23/153 |
| 3,689,216 | 9/1972 | Brown | 423/483 |
| 3,743,704 | 7/1973 | West | 423/490 |
| 3,773,633 | 11/1973 | Teller | 204/67 |
| 3,798,875 | 3/1974 | Morris | 55/22 |
| 3,825,655 | 7/1974 | Heltaver | 44/1 SR |
| 3,850,477 | 11/1974 | Aldrich et al. | 299/5 |
| 3,852,430 | 12/1974 | Lienau et al. | 423/481 |
| 3,863,846 | 2/1975 | Keller, Jr. et al. | 241/1 |
| 3,870,237 | 3/1975 | Aldrich | 241/1 |
| 3,918,761 | 11/1975 | Aldrich | 299/5 |
| 3,926,575 | 12/1975 | Meyers | 44/1 SR |
| 3,961,030 | 6/1976 | Wiewiorowski et al. | 423/126 |
| 3,971,845 | 7/1976 | Becker et al. | 423/483 |
| 3,976,447 | 8/1976 | Merchant et al. | 35/71 |
| 3,993,455 | 11/1976 | Reggel et al. | 44/1 R |
| 3,998,604 | 12/1976 | Hinkley | 44/1 R |
| 4,025,459 | 5/1977 | Wristers | 252/429 R |
| 4,032,621 | 6/1977 | Meadows | 423/488 |
| 4,054,421 | 10/1977 | Robinson | 44/1 F |
| 4,062,929 | 12/1977 | Thompson et al. | 423/483 |
| 4,069,296 | 1/1978 | Huang | 423/127 |
| 4,071,328 | 1/1978 | Sinke | 44/1 R |
| 4,080,176 | 3/1978 | Verschuur | 44/1 R |
| 4,081,250 | 3/1978 | Hsu et al. | 44/1 R |
| 4,081,251 | 3/1978 | Colli | 44/1 SR |
| 4,083,940 | 4/1978 | Das | 423/449 |
| 4,118,200 | 10/1978 | Kruesi | 44/1 R |
| 4,119,410 | 10/1978 | Kindig et al. | 44/1 SR |
| 4,120,939 | 10/1978 | Ehlig | 423/483 |
| 4,134,737 | 1/1979 | Yang | 44/1 R |
| 4,144,315 | 3/1979 | Worthington et al. | 423/490 |
| 4,154,804 | 5/1979 | Walker et al. | 423/240 |
| 4,163,045 | 7/1979 | VanderMeer et al. | 423/483 |
| 4,169,710 | 10/1979 | Jensen | 44/1 S R |
| 4,173,530 | 11/1979 | Smith et al. | 209/9 |
| 4,178,231 | 12/1979 | Smith et al. | 209/3 |
| 4,178,233 | 12/1979 | Smith et al. | 209/3 |
| 4,192,650 | 3/1979 | Seitzer | 44/1 R |
| 4,202,757 | 5/1980 | Amendola | 208/10 |
| 4,213,765 | 7/1980 | Wilson | 44/15 R |
| 4,213,951 | 6/1980 | Sikclar et al. | 423/339 |
| 4,244,699 | 1/1981 | Smith et al. | 44/1 SR |
| 4,248,698 | 2/1981 | Keller, Jr. | 209/5 |
| 4,252,639 | 2/1981 | Smith | 209/5 |
| 4,260,394 | 4/1981 | Rich | 44/1 S R |
| 4,265,737 | 5/1981 | Smith et al. | 209/3 |
| 4,274,946 | 6/1981 | Smith et al. | 209/5 |
| 4,278,442 | 7/1981 | Matsuda | 44/1 R |
| 4,288,411 | 9/1981 | Holland et al. | 423/1 |
| 4,292,289 | 9/1981 | Cannon et al. | 423/301 |
| 4,324,560 | 4/1982 | Fonseca | 44/1 S R |
| 4,325,707 | 4/1982 | Kalvinskas | 44/1 |
| 4,355,017 | 10/1982 | Gamson et al. | 423/484 |
| 4,377,391 | 3/1983 | Cottell | 44/51 |
| 4,424,062 | 1/1984 | Kamino et al. | 44/1 S R |

INTEGRATED COAL CLEANING PROCESS WITH MIXED ACID REGENERATION

This application is a continuation-in-part of applications Ser. Nos. 517,338; 517,339; 517,340; and 517,362 all filed July 26, 1983 (all now abandoned).

FIELD OF INVENTION

This invention relates to processes for producing environmentally acceptable fuels from coal and, in particular, to hydrometallurgical processes for chemically liberating and/or removing contaminants from coal. This invention also relates to producing HF and HCl and mixtures thereof by utilizing pyrohydrolysis and sulfation.

BACKGROUND OF THE INVENTION

Energy demands by the industrialized world are continuing to rise, while the rate of new oil discoveries is falling. Within the next 30 years, available petroleum supplies will fail to meet demand, and oil will no longer be able to serve as the world's major energy source. Other energy sources such as geothermal, solar, and fusion are unlikely to be sufficiently developed to serve as replacements for oil. Coal, on the other hand, exists in relative abundance in the United States, and if it can be adapted for use in existing plants which have been engineered for petroleum use, it can serve as an inexpensive substitute for, and successor to, the more expensive oil fuels in use today. In order to be used as an oil substitute, however, the coal must be converted to a fluid state exemplified by the finely-ground leached coal product of this invention, so that systems burning fuel oil, diesel fuel, and other petroleum products can be adapted to its use with minimal equipment modification. The coal must also be cleaned, or purged of its mineral matter (ash precursor) content, to permit its use without fouling, damaging or reducing the efficiency of the combustion equipment, to reduce or eliminate the requirement for post combustion gas clean up, and to increase fuel value per pound for efficient handling and use; and its sulfur content must be reduced to minimize off-gas cleanup, so as to meet environmental pollution standards.

It is known that coal may be cleaned of its mineral matter by an acid leach. While efforts have been made to utilize HF and HCl to clean coal by dissolving away its ash constituents, known methods are cumbersome and expensive. Additionally, the methods directed to cleaning coal via the acid leach have primarily related to small scale coal processing. The problems involved in large scale processing, such as manufacturing plants dedicated to processing coal as a petroleum product substitute, have not been adequately addressed. In a large commercial operation, the coal processing steps must be consolidated and simplified for economic cost considerations in order to compete as an alternative for oil and gas.

U.S. Pat. No. 4,169,710 assigned to Chevron describes a process for the use of concentrated hydrogen halide, such as hydrogen fluoride, as a comminuting agent for raw coal. The patent also discloses the use of the hydrogen halide to dissolve and remove ash and sulfur from raw (unground) coal. This patent mentions that the hydrogen halide may be purified and recycled; however, no procedure for doing so is disclosed. The Chevron patent does not disclose the use of finely-ground, hydrogen fluoride/hydrogen chloride-purged coal as a substitute for fluid fuels or other forms of finely-divided, highly purified hydrocarbons.

European Patent Application No. 80300800.2, filed Mar. 14, 1980, and published Oct. 1, 1980, under Publication No. 0 016 624, by Kinneret Enterprises, Ltd., discloses a coal de-ashing process utilizing liquid or gaseous hydrogen fluoride to remove silica and/or aluminum bearing mineral matter and other reactive materials from substances, such as coal, which do not react with hydrogen fluoride under the same conditions. The hydrogen fluoride is recovered as a gaseous product at several stages. In the Kinneret process, hydrogen fluoride in gaseous form contacts the coal, which is first ground to −200 mesh. The unreacted gas is then separated by density methods and recycled. An aqueous solution of 20–30% hydrogen fluoride is then used to leach the formed fluoride minerals away from the coal, and hydrogen fluoride gas is recovered from this solution at raised temperatures and pressures, simultaneously causing the crystallization of aluminum, calcium, magnesium, and manganese fluorides. Other minerals including titanium, potassium, and sodium fluorides remain in solution. The heavy gas fraction resulting from the hydrogen fluoride gas treatment of the coal is contacted at elevated temperatures and pressures with water in two subsequent stages to remove sulfur and silicon dioxide and produce gaseous hydrogen fluoride in both cases for recycle. The Kinneret publication discloses the comminution of a coal prior to treating with hydrogen fluoride to remove mineral content, it does not disclose a procedure for producing a product suitable as a liquid fuel substitute or other applications as discussed above.

Bureau of Mines Report of Investigations No. 5191, "Coal As A Source of Electrode Carbon In Aluminum Production," (Feb., 1956) at page 7 discloses the use of froth flotation followed by hydrofluoric-hydrochloric acid leaching, using a boiling solution containing 5 parts of the combined acids to 95 parts water. At page 29, the use of a 2.44 Normal solution of hydrofluoric-hydrochloric acid is used to leach coal at boiling temperatures. There is no teaching or suggestion that milder, even ambient, temperatures can be employed nor is there a discussion regarding large scale operations and/or the need to regenerate the mixed acids.

U.S. Pat. No. 4,083,940 to Das discloses the use of a 0.5–10% hydrofluoric acid solution in combination with an oxidizing agent such as nitric acid, to purify coal to electrode purity (0.17% ash). A gaseous oxygen-containing material is bubbled through the mixture during leaching to provide additional mixing action and oxidation.

U.S. Pat. No. 3,961,030 to Wiewiorowski et al. describes the use of a 10–80% hydrogen fluoride solution to leach clay for the recovery of aluminum. Hydrogen fluoride is recovered for recycle by the addition of water and heat to aluminum fluoride. The recovered hydrogen fluoride can be dissolved in water and recycled in aqueous form.

U.S. Pat. No. 2,808,369 to Hickey describes the treatment of coal with fluoride salts, and with hydrogen fluoride gas, after first heating the coal to effect a partial devolatilization.

Other patents which describe methods to clean coal include U.S. Pat. No. 4,071,328 to Sinke, describing the removal of FeS from coal by hydrogenation and contact with aqueous hydrogen fluoride. U.S. Pat. Nos.

3,870,237 and 3,918,761 to Aldrich disclose the use of moist ammonia for in situ treatment of coal to fragment the coal and facilitate the separation of inorganic components. U.S. Pat. No. 3,863,846 to Keller, Jr., et al. describes an apparatus and method for the utilization of anhydrous ammonia as a coal comminuting agent.

One of the major disadvantages of coal cleaning processes not adequately addressed in the prior art is regeneration of the spent acid leach liquors and capture and reuse after regeneration of substantially all fluorine values throughout all processing circuits. HF is an expensive reagent, so that its use is uneconomical unless it can be recycled. There are known methods of producing both HF and HCl, typically involving treating a readily available and inexpensive source of fluoride or chloride, e.g. $CaF_2$ or NaCl, to produce the desired acid. For example, U.S. Pat. No. 4,120,939 describes a process for the production of hydrogen fluoride gas from the reaction of calcium fluoride particles with sulfuric acid formed in situ from sulfur dioxide and steam.

While there are known methods of producing HF and HCl, regeneration of spent HF/HCl from industrial streams presents new difficulties not encountered in production from pure reagents. Additionally, HCl and, particularly, HF are corrosive pollutants and recycling the spent acid liquor reduces the cost of environmentally acceptable disposal. HF and HCl have a wide variety of uses in commercial processes. The acids are used in chemical, refining, metallurgical and for hydrometallurgical processes for leach of ores and concentrates and for pickling of metals. In addition, HCl is often used in the processing of ores as a chlorination agent.

Known methods to regenerate HF and HCl from industrial waste, including gaseous as well as aqueous liquid streams containing metal halides, generally utilize the methods of pyrohydrolysis or sulfation depending upon the source and thus the constituents of the waste stream. U.S. Pat. No. 4,325,935 to Krepler relates a method of producing hydrofluoric acid from a solution of heavy metal fluorides by contacting with water vapor at elevated temperature and pressure. There is no teaching as to sulfation of the waste.

Most methods of disposing of HF involve removal of HF from gaseous streams by in-line scrubbing with lime water, an aqueous calcium hydroxide system. In this system, insoluble $CaF_2$ is formed from the contacting of the HF with the aqueous slurry of CaO. Commercial operating plants utilizing HF generally provide such an in-line gas scrubbing system which captures HF expelled from various points in the process. The $CaF_2$ sludge is not usually treated to recover and regenerate the HF. Although this scrubbing system may prevent environmental HF pollutant problems, it does represent a loss of HF and requires the mining of more fluorspar, $CaF_2$, to replace the loss.

Pyrohydrolysis involves subjecting the industrial wastes to high temperature in the presence of water vapor to convert some metal halides to the halogen acid (HF or HCl) and the corresponding metal oxides. However, the specific ability to regenerate the acids and the process steps and parameters involved are almost wholly dependent upon the character and complexity of the starting waste stream. Moreover, the level of halogen recovery depends in large part on the susceptibility of the particular metal halides to conversion. For example, Si, present in aqueous acid waste liquors as fluorosilicic acid, $H_2SiF_6$, will pyrohydrolyze according to the following formula:

$$H_2SiF_6\ (\text{aqueous}) \rightarrow 2HF + SiF_4 + (H_2O\ \text{gas}) \quad \text{(i)}$$

$$SiF_4 + 2H_2O \rightarrow 4HF + SiO_2. \quad \text{(ii)}$$

However, to achieve total fluoride recovery, the pyrohydrolytic conditions involve heating the liquor to temperatures around 1000° C., at ambient pressure, and contacting the liquor with a stoichiometric excess of water vapor. In addition, calcium and magnesium halides from aqueous feed solutions will not pyrohydrolyze to their respective oxides at any reasonable temperature, e.g. below about 1200° C. U.S. Pat. No. 3,511,603 to Yaws teaches a method for the production of anhydrous hydrogen fluoride from aqueous fluorosilicic acid by decomposing the fluorosilicic acid, fluorinating a metal oxide of iron, copper, nickel, or chromium with the aqueous hydrogen fluoride, and then defluorinating the metal oxide for recycling and producing the anhydrous hydrogen fluoride. The defluorination step involves contacting the metal fluoride with steam at an elevated temperature. U.S. Pat. No. 3,852,430 to Lienau describes a process of regenerating a halogen halide, in particular HCl, and the corresponding metal oxides from the potash industry and titanium ore processing waste streams. This patent teaches preconcentrating the aqueous solution prior to subjecting the waste stream to pyrohydrolysis.

Calcium and sodium halides are generally treated by sulfation to produce the halide acid and the corresponding metal sulfate. Sulfation involves the contacting of certain metal halides with sulfur dioxide, oxygen and water vapor at elevated temperatures to produce the halide acid and the corresponding metal sulfate. Generally, sulfation is taught to occur at lower temperatures than pyrohydrolysis. None of the prior art references teach regeneration of HF and HCl or mixtures thereof by the competing reactions of a complex aqueous leach solution subjected to both pyrohydrolysis and sulfation. Moreover, none teach that pyrohydrolysis and sulfation can be achieved in a single reactor under one set of conditions to produce the metal oxides and metal sulfates and the corresponding HF and HCl gas.

It is apparent that there is a need for a method of regenerating HF and HCl and mixtures thereof from complex industrial waste streams utilizing a single regeneration unit. The difficulty presented, however, is that when multiple metal halides, i.e. different metal fluorides and/or different metal chlorides, are present in the spent aqueous leach liquor, there are competing, simultaneous reactions during both pyrohydrolysis and sulfation because the metal halides consume common reactant(s) ($H_2O$ during pyrohydrolysis and $H_2O$, $SO_2$ and $O_2$ during sulfation), and produce a common product (HF/HCl). Additionally, the equilibrium constants for the reaction of each metal halide differ and thus the temperature necessary to drive one reaction toward HF/HCl production may cause another reaction to convert back to the halide salts.

None of the known references suggest that pyrohydrolysis and sulfation can be achieved at the same time in a single reactor under one set of conditions to produce the metal oxides and metal sulfides and the corresponding HF and HCl gas. Thus, one part of the present invention advantageously teaches methods of producing HF and HCl and mixtures thereof, while producing an environmentally acceptable calcine, suitable for disposal without additional treatment. The methods of the present invention have applicability to a variety of commercial industries using these acids in their processes.

The present invention also solves the problems of producing a clean coal, suitable for use as an alternative fuel source, by providing an integrated and simplified system of manufacturing such a coal economically. None of the references teach or suggest an overall system for cleaning coal wherein substantially all of the fluorine values throughout the process except for that reporting to waste as $MgF_2$ are recaptured and converted to HF, wherein a mixed acid leach is used and regenerated in substantially the same ratio of HF to HCl and wherein the entire process requires only inexpensive $CaF_2$ and NaCl as halide make-up reagents. The purged coal of the present invention, when finely-ground, is usable not only as a substitute for petroleum fuels, for example, as a coal water mixture, but may also substitute for activated carbon, or as a feedstock for carbon black, electrode carbon, and various chemical processes.

BRIEF SUMMARY OF THE INVENTION

The present invention provides processes for the continuous removal of contaminants from coal to produce a clean purified fuel. The processes generally comprise producing a clean coal product having a mineral matter content of less than about 5 percent by weight from coal and coal derivatives by leaching feed coal crushed or sized to less than about 1 inch with a mixture of hydrochloric and hydrofluoric acids comprising less than about 70 weight percent HF and less than about 38 weight percent HCl at atmospheric pressure and at a temperature below the boiling point of the acid mixture.

One embodiment of the present invention provides a process for producing a coal product with 5 percent ash content or less comprising comminuting raw coal or other coal-derived feed material to a size less than about 10 mm; leaching the comminuted coal with a mixture of HF and HCl comprising less than about 70 percent by weight HF and less than 38 percent by weight HCl at atmospheric pressure and a temperature below boiling, preferably ambient; separating the leached residue from the spent acid; washing the leached residue substantially free of spent acids and dissolved solids; separating pyrite from the coal by physical means; reducing halogens on the coal to an acceptable level by thermal treatment; and regenerating the mixture of HF and HCl by dual pyrohydrolysis and sulfation of the spent acids to recover substantially all of the fluorine value except for that reporting to waste as $MgF_2$, either as HF or as volatile fluorides which are recycled.

The present invention also provides processes for regeneration of HCl/HF from aqueous solutions which contain a wide variety of halide salts. In particular, there are provided methods of producing hydrogen halides selected from the group consisting of HF, HCl, and mixtures thereof from an aqueous solution comprising at least two metal halide salts, one selected from each of the groups (a) and (b). Group (a) salts have the formula $MX_a$ and will pyrohydrolyze to their oxide and hydrogen halide. Group (b) salts salts have the formula $M'X'_b$ and will not pyrohydrolyze to their oxide at temperatures below about 1200° C.; but will sulfate in the presence of $SO_2$, $H_2O$ and $O_2$ and thereby form hydrogen-halide and metal sulfates, the hydrogen halides being separated from the oxide/sulfate calcine in the hot off-gases. Typically, M is selected from the group consisting of Al, Ti, Fe, and P and M' is selected from the group consisting of Na, K and Ca. X and X' are each a halide selected from the group consisting of fluoride and chloride and wherein at least one halide salt is a fluoride and one halide salt is a chloride; and a and b are each integers having a value equal to the positive valence state of M and M', respectively. The processes generally comprise contacting the aqueous solution in the presence of $SO_2$ with a hot gas comprising water vapor, and oxygen at an elevated temperature and for a sufficient time for the M metals to be pyrohydrolyzed to form their respective oxide salts and the M' metals to be sulfated to form their respective sulfates, and HF and HCl to be produced therefrom.

DETAILED DESCRIPTION

Figure 1:
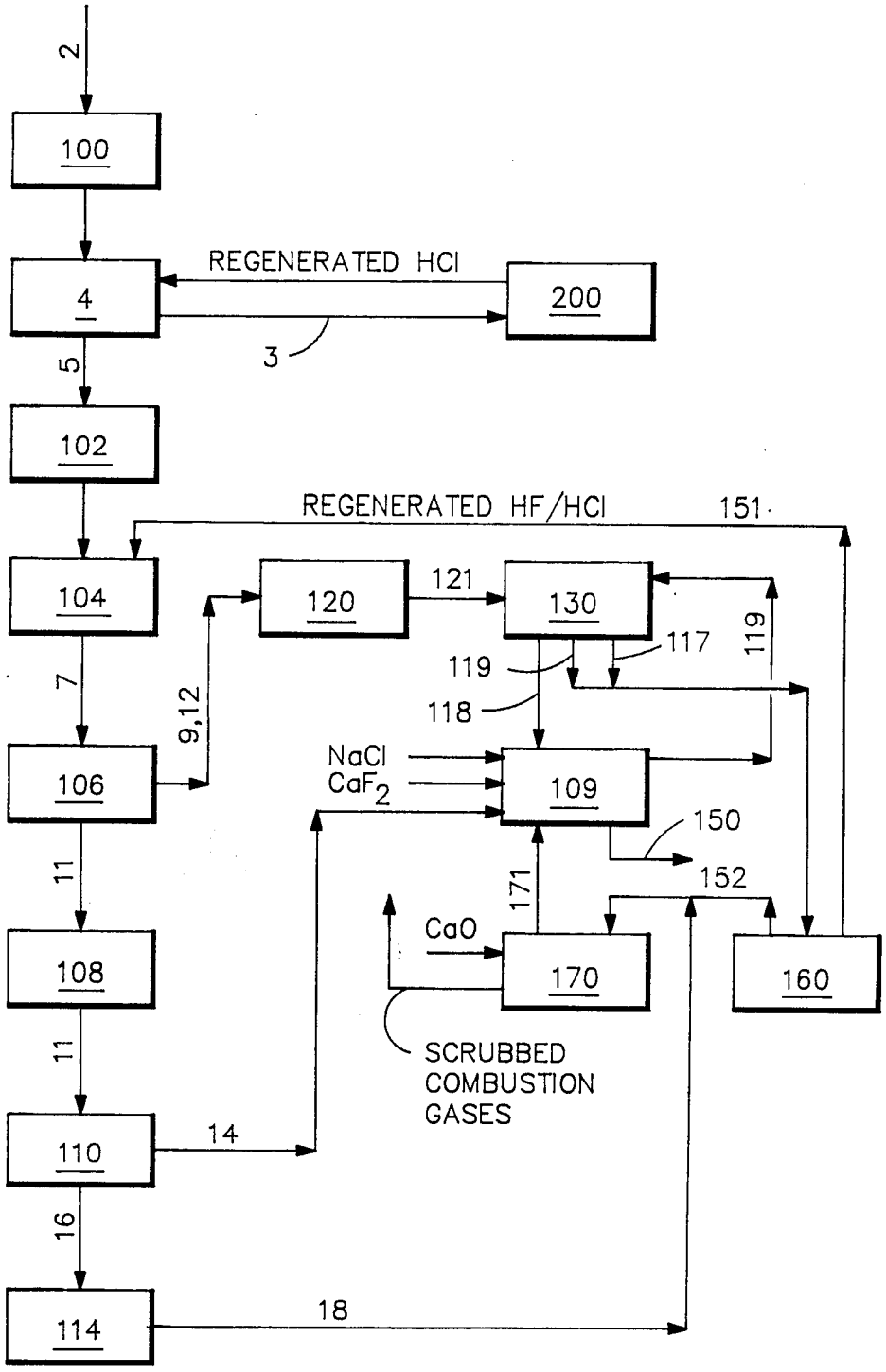
FIG. 1 is a schematic flow diagram of one embodiment of the present invention.

The processes of the present invention combine mixed hydrofluoric and hydrochloric acid leaching of the coal with specific additional steps to obtain coal product substantially free of contaminants, i.e. a product containing less than 5 percent by weight, more preferably containing less than from about 3.0 to less than about 1.0 percent by weight, and most preferably less than 0.2 percent by weight mineral matter (ash precursors). Virtually any coal solid, i.e. solid hydrocarbon including peat, coal, lignite, brown coal, gilsonite, tar sand, etc., including coal-derived products (hereinafter collectively referred to as "coal") may be treated by the processes of the present invention. Coal is a random mixture of dozens of minerals and moisture (impurities) with the hydrocarbons. The mixture varies from deposit to deposit, affected by differences in the original vegetation, heat, pressure, hydrology, and geologic age. Table A lists the common minerals found in coal.

TABLE A

| Common Minerals Found in Coal |
|---|
| Muscovite ($KAl_2(AlSiO_3O_{10})(OH)_2$) |
| Hydromuscovite |
| Bravaisite |
| Kaolinite ($Al_2Si_2O_5(OH)_4$) |
| Levisite |
| Metahalloysite |
| Siderite ($FeCO_3$) |
| Hematite ($Fe_3O_4$) |
| Sylvite (KCl) |
| Halite (NaCl) |
| Quartz ($SiO_2$) |
| Feldspar $(K,Na)_2O.Al_2O_3.6SiO_2$ |
| Zircon ($ZrSiO_4$) |
| Diaspore ($Al_2O_3.H_2O$) |
| Lepidocrocite ($Fe_2O_3.H_2O$) |
| Kyanite ($Al_2O_3.SiO_2$) |
| Staurolite ($2FeO.5Al_2O_3.4SiO_2.H_2O$) |
| Topaz $(AlF)_2SiO_4$ |
| Tourmaline $H_9Al_3(BOH)_2Si_4O_{19}$ |
| Pyrophyllite ($Al_2Si_4O_{10}(OH)_2$) |
| Illite $(K(MgAl,Si)(Al,Si_3)O_{10}(OH)_8$ |
| Montmorillonite $(MgAl)_8(Si_4O_{10})_3(OH)_{10}.12H_2O$ |
| Prochlorite $(2FeO.2MgO.Al_2O_3.2SiO_2.2H_2O)$ |
| Chlorite $(Mg,Fe,Al)_6(Si,Al)_4O_{10}(OH)_8$ |
| Gypsum ($CaSO_4.2H_2O$) |
| Barite ($BaSO_4$) |
| Penninite $(5MgO.Al_2O_3.3SiO_2.2H_2O)$ |
| Ankerite $CaCO_3.(Mg,Fe,Mn)CO_3$ |

TABLE A-continued

| Common Minerals Found in Coal |
|---|
| Garnet ($3CaO.Al_2O_3.3SiO_2$) |
| Hornblende ($CaO.3FeO.4SiO_2$) |
| Apatite ($9CaO.3P_2O_5.CaF_2$) |
| Epidote ($4CaO.3Al_2O_3.6SiO_2.H_2O$) |
| Biotite ($K_2O.MgO.Al_2O_3.3SiO_2.H_2O$) |
| Augite ($CaO.MgO.2SiO_2$) |
| Calcite ($CaCO_3$) |
| Magnetite ($Fe_2O_3$) |
| Pyrite ($FeS_2$) |
| Marcasite ($FeS_2$) |
| Sphalerite ($ZnS$) |

The minerals (precursors of ash) in coal impede the combustion of the hydrocarbons and create problems ranging from ash removal to the release of airborne pollutants, e.g. oxides of the sulfur which are present in coal dominantly in two forms, pyritic and organic.

In the practice of the present invention the particular combination of process steps and/or the process conditions for such steps are in large part determined by the level and nature of impurities in the particular feed coal.

Treatments prior to contact with mixed acids

Depending on the particular feed, it is advantageous to physically and/or chemically pre-treat the coal feed prior to leaching.

A. Physical Separation—For coals that are high in gangue minerals, previously described, the gangue should be physically separated from the coal prior to other treatment, provided the separation process is not accompanied with a concomitant high loss of heating values.

B. Drying—Feed coal such as sub-bituminous lignites or other low-rank coals may be dried prior to further treatment. Where the feed is Western, hereinafter referred to as U.S. sub-bituminous or lower rank coals, as defined by thermal value, which typically contain about 25 weight percent moisture or more, it is particularly advantageous to dry the feed to substantially reduce this inherent moisture content, preferably, to below about 5 percent by weight.

C. Crushing/Sizing—With most feeds, the contaminant removal process is enhanced by crushing or sizing the feed to a particular size of less than 1 inch, typically less than 10 mm, preferably less than about 5 mm, and more preferably less than about ½ mm.

D. HCl Pre-Leach—Some feeds, and in particular, those with relatively high amounts of ash minerals containing calcium, such as calcite and dolomite, are advantageously pre-leached with a mild, sometimes cold, hydrochloric acid leach whereby calcium and magnesium which might otherwise interfere with the mixed acid leach are precluded entry into the mixed acid circuit. If calcium and magnesium are not removed there is a rapid build up of $Ca^{2+}$ and $Mg^{2+}$ ions in the mixed acid leach which favors precipitation of insoluble fluorides even in the presence of chloride ions; this precipitation of fluorides constitutes a loss of fluorine values and is a disadvantage to the process. In particular, as described more fully hereinafter, the level of Mg present contributes to the amount of fluorine lost to the entire system.

By mild leach is meant one of less than about 20 weight percent HCl and temperatures below about 40° C. In some instances, however, this HCl pre-leach may be carried out at higher temperatures, e.g. from about 40° C. to boiling. Leaching times of about 1 hour are typically effective for 96% calcium removal at 10% acid, but up to 4 hours may be used. In general, conditions of acid strength, time and temperature are adjusted to effect calcium removal to a level of less than about 1000 ppm. Following leaching, a solid/liquid separation is made, the solids are washed and then proceed to the HF/HCl leach. The spent HCl leach liquor is recaptured and regenerated by pyrohydrolysis.

Mixed Hydrofluoric and Hydrochloric Acid Leach

According to the processes of the present invention the coal feed, optionally pre-treated by one or more of the pre- leach treatments described hereinbefore, is contacted with a mixture of hydrofluoric and hydrochloric acids at ambient pressure and temperature below boiling, preferably ambient. Of the 39 minerals listed in Table A, HF is reactive in attacking the first 35 therein listed, particularly, the silicates and aluminosilicates including clays and shales. However, the last 15 minerals of the group of 35 contain (or may contain) alkaline earth elements, i.e. elements from Group II of the atomic table, and these elements generally form fluorides of extreme low solubility. The 15 minerals include alkaline earth-containing silicates, carbonates and sulfates, and although hydrofluoric acid alone would attack these structures it would metathesize them to insoluble fluorides. The presence of hydrochloric acid, however, increases the solubility of these otherwise insoluble alkaline earth fluorides. Neither HF nor HCl in the mixed acid is considered reactive with the hydrocarbons in coal. During the HF/HCl leach, the ash-forming silicates are dissolved whether they are free (liberated); attached to coal; contained in any crack, cleat or pore accessible to the leach solution; or even attached to pyrite.

In a preferred embodiment, the leaching mixture comprises the following initial acid concentrations: HF from about 5 to about 70 percent by weight and HCl from about 3 to about 38 percent by weight; more preferably with an HF concentration from about 10 to about 40 percent by weight and an HCl concentration of from about 5 to about 20 percent by weight; and most preferably HF about 20 percent by weight and HCl about 10 percent by weight. The leach may be co-current or countercurrent.

Acid Regeneration

For the coal purification processes to be economical, the mixed acid used in leaching must be regenerated and recycled into the coal purification system. Additionally, the metal halide salts contained in the spent mixed acids leach liquor must be treated to yield an environmentally satisfactory material for disposal, generally the metal oxides or sulfates. Using a mixture of HF and HCl leach, the most abundant metal halide salts formed from the coal leaching process are those of Si, Al, Ti, Fe, Ca, Mg, Na, K, P, and Ba although minor amounts of metal halide salts are formed with other mineral constituents present in the coal, such as Li, Be, B, Sc, V, Cr, Mn, Co, Ni, Ca, Zn, Ga, Ge, As, Se, Rb, Sr, Y, Zr, Nb, Mo, Ag, Cd, Sn, Sb, Te, Cs, La, Ce, Pr, Nd, Sm, Eu, Gd, Tb, Dy, Ho, Er, Tm, Yb, Lu, Hf, Ta, W, Tl, Pb, Bi, Th and U. In order to effectively regenerate the mixed acid solution, substantially all of the metal halide salts must be converted into their respective oxides and sulfates, and the corresponding halide acids.

The process of recovering the mixed acids utilizes both pyrohydrolysis and sulfation in pyrohydrolyzing conditions. The process generally comprises spraying the aqueous feed solution into a hot fluid bed reactor which exposes the aqueous solution of halides to a mixture of solids and gases. Also present in the pyrohydrolyzer or fluid bed reactor is sulfur as $SO_2$, oxygen, and as required, excess water vapor. The mixed acids are regenerated and the constituents derived from heating the aqueous solution are converted into either oxides or sulfates. The regenerated mixed acids, gaseous HF/HCl, are removed with the hot off-gases of the regeneration system while the oxides/sulfates formed are separated therefrom in the environmentally acceptable calcine produced. The calcine will also contain $MgF_2$, a highly insoluble fluoride, representing a fluorine loss of the integrated system described herein.

Examples of some of the applicable chemical reactions of the HF/HCl regeneration are as follows:

$$2AlF_{3(s)}+3H_2O_{(g)}\rightarrow Al_2O_{3(s)}+6HF_{(g)} \quad \text{(iii)}$$

$$SiF_{4(g)}+2H_2O_{(g)}\rightarrow SiO_{2(s)}+4HF_{(g)} \quad \text{(iv)}$$

$$TiF_{4(g)}+2H_2O_{(g)}\rightarrow TiO_{2(s)}+4HF_{(g)} \quad \text{(v)}$$

$$4PF_{5(g)}+10H_2O_{(g)}\rightarrow P_4O_{10(g)}+20HF_{(g)} \quad \text{(vi)}$$

$$2FeF_{3(g)}+3H_2O_{(g)}\rightarrow Fe_2O_{3(s)}+6HF_{(g)} \quad \text{(vii)}$$

$$CaF_2(s)+H_2O_{(g)}+sO_{2(g)}+0.5\,O_{2(g)}\rightarrow CaSO_{4(s)}+2HF_{(g)} \quad \text{(viii)}$$

$$2NaCl_{(s,1)}+H_2O_{(g)}+SO_{2(g)}+0.5\,O_{2(g)}\rightarrow Na_2SO_{4(s,1)}+2HCl_{(g)} \quad \text{(ix)}$$

$$2KCl_{(s)}+H_2O_{(g)}+SO_{2(g)}+0.5\,O_{2(g)}\rightarrow K_2SO_{4(s)}+2HCl_{(g)} \quad \text{(x)}$$

The ability to regenerate mixed HF/HCl from complex waste streams containing multiple chlorides and fluorides by practice of the present invention is in part due to the discovery that when the aqueous feed initially containing chlorides is brought under pyrohydrolysis and sulfation conditions in the presence of HF, metal chlorides, other than NaCl and KCl, are converted to fluorides as illustrated by the following reactions:

$$FeCl_3+3HF\rightarrow FeF_3+HCl \quad \text{(xi)}$$

$$AlCl_3+3HF\rightarrow AlF_3+HCl \quad \text{(xii)}$$

The resulting fluorides are then acted upon according to reactions such as those provided hereinabove.

Treatments prior to acid regeneration

A. Si Removal—According to the process of the present invention, any Si present in the mixed acids leach liquor may optionally be removed prior to pyrohydrolysis and sulfation. In the aqueous solution containing Si, the Si is generally bound as fluorosilicic acid, $H_2SiF_6$. One process for removing Si from the leach liquor is by heating to the point where the fluorosilicic acid disassociates as follows:

$$H_2SiF_6\ \text{(aqueous)}\rightarrow 2HF+SiF_4+(H_2O\ \text{gas}) \quad \text{(i)}$$

Another process for removing the Si generally comprises precipitating the Si and removing the precipitant from the aqueous feed solution by filtration. In this Si removal method, an aluminum oxide-rich material containing approximately 30 percent or more by weight $Al_2O_3$ is contacted with the aqueous solution. Upon introduction of the $Al_2O_3$ for precipitation of the Si, the $H_2SiF_6$ and $Al_2O_3$ react according to the following formula:

$$Al_2O_3+H_2SiF_6\rightarrow 2AlF_3+SiO_2\ \text{(ppt)}+H_2O. \quad \text{(xiii)}$$

The $SiO_2$ precipitate is removed by any convenient means, for example by filtration. The remaining aqueous halide filtrate is then advantageously subjected to the pre-heat/pre-concentration step described hereinbelow before advancing to pyrohydrolysis/sulfation.

B. Pre-heat/pre-concentration—For economic cost considerations, prior to the pyrohydrolysis/sulfation, the spent mixed acid feed, particularly one from which Si has been removed, is pre-heated and pre-concentrated by utilizing the heat from the pyrolysis off-gases. Where Si has been previously removed from the spent leach liquor, the liquor may be directly heated and evaporated by the hot off-gas stream from the mixed acids regeneration. This direct heating may be accomplished in any suitable reactor equipment, such as a cyclone. This pre-heat/pre-concentration step forms a $H_2O$ vapor and a concentrated liquor. The concentrated liquor is then advanced to the mixed acids regeneration step. The water vapor and the off-gases are directed to at least one absorber where the aqueous HF/HCl mixed acids are formed. The water produced may ultimately be used elsewhere in the leaching circuit, e.g. washing.

Where Si is not removed from the spent liquor, in the pre-heat/pre-concentration step, the aqueous liquor is introduced into an indirect multiple effect evaporator and indirectly heated by the off-gas stream. This indirect heating is accomplished by heating $H_2O$ to steam with the hot off-gas from the fluid bed reactor in a waste heat boiler. The steam is then used to indirectly heat the aqueous spent acid liquor solution. Because of the $H_2O$ requirement for the reactions in the pyrohydrolyzer/sulfation unit when Si is present, both the concentrated aqueous solution and the vapor formed from the indirect heating comprise the aqueous waste feed for the pyrohydrolysis/sulfation.

If the Si present in the spent aqueous solution is not removed, the decomposition of $SiF_4$ to $SiO_2$ and HF by pyrohydrolysis can result in a loss of fluorine values unless excess water vapor is present. Should Si be present in the pyrohydrolysis/sulfation step, the water vapor should be present in an amount equal to from one (1) to about ten (10) times or more the stoichiometric amount of $H_2O$ necessary to regenerate HCl/HF from all the fluorides and chlorides present in the spent liquor.

As indicated above, the Si is present in the spent aqueous liquor as $H_2SiF_6$. Upon introduction of the aqueous liquor into the fluid bed reactor, the fluorosilicic acid reacts to form $SiF_4$. However, it has been discovered that at appropriate temperatures and with an excess of water vapor present in the fluid bed reactor according to the present invention, substantially all of the $SiF_4$ can be converted to form HF and $SiO_2$ along with the substantially complete conversion of all other fluorides and chlorides present in the feed.

To assure adequate conversion of silicon fluoride, the water vapor must be in excess of the stoichiometric requirement for all metal halides present. In preferred embodiment, the water vapor should be present in an amount at least equal to about one (1), preferably at least about five (5) and, most preferably, at least about ten (10) times the stoichiometric amount of water required to convert all metal halides present to their oxides or sulfates, in order to achieve substantial Si conversions, say greater than 80%. As will be known and understood by those skilled in the art, water vapor may be present from about the stoichiometric equivalent if the F value loss as $SiF_4$ is not controlling with virtually no upper limit. The primary disadvantage of too large an $H_2O$ excess is in the energy required to raise the temperature of large quantities of $H_2O$ to the pyrohydrolysis/sulfation reaction temperature.

Appropriate temperatures for practice of the regeneration of the present invention are typically from about 500° C. to about 1100° C., more typically from about 700° C. to about 900° C., with the preferred temperatures at about 750° C. to about 850° C., most preferred at about 800° C. As will be understood by those skilled in the art the temperature range is one of optimization with the process operable at temperatures outside the specified range. At temperatures above 900° C., and in the presence of excess water vapor, increased amounts of $SiF_4$ can be converted to recover the HF. As such where total conversion of $SiF_4$ to HF is the only concern the upper temperature range is limited only by the practical consideration of reactor construction materials. However, it has been discovered that at temperatures of about 800°C.–900° C., the equilibrium constant of the $CaSO_4$ is lower and back reaction to $CaF_2$, can predominate. Similarly, the equilibrium constant for formation of $FeF_3$ decreases with increasing temperature and as such back reaction to $FeF_3$ increases with increasing temperature. In the context of an overall system, i.e. where HF/HCl produced is recycled for use as a leach mixture, e.g. to clean coal, unreacted $CaF_2$ and $AlF_3$, as solids separated from the hot acid gases, typically by a hot cyclone, represent an irretrievable loss of fluorine value. Therefore, temperatures and excess water levels thus are set to obtain 100% conversion of $CaF_2$ and $AlF_3$, and maximized, although not necessarily complete, conversion of $SiF_4$, $TiF_4$ and $FeF_3$ (i.e. fluorides which report with the off-gases). Lesser conversions of $SiF_4$, $TiF_4$ and $FeF_3$ (and other fluorides volatile at reactor temperatures) are tolerable because unlike solids such as $AlF_3$ and $CaF_2$, unreacted $SiF_4$, $TiF_4$ and $FeF_3$ are recycled as gases and may ultimately be reacted to form oxides and HF. As will be known and understood, $MgF_2$ although reporting to the calcine is not a factor in optimization since it is neither pyrohydrolyzed nor sulfated.

The trade-offs resulting from increasing or decreasing reaction temperature and/or the amount of $H_2O$ present in the system are demonstrated by the data provided in Table 1.

TABLE 1

| Conditions | | Conversions (% of Element Converted to Acid) | | | | | | | |
|---|---|---|---|---|---|---|---|---|---|
| Temp °C. | % Excess Water | Si | Al | Ti | Fe | Ca | Mg | Na | $P_2O_5$ |
| 700 | 100 | 0 | 0 | 97.8 | 65.5 | 100 | 0 | 100 | 100 |
| | 500 | 3.8 | 100 | 99.5 | 86.6 | 100 | 0 | 100 | 100 |
| | 1000 | 52.6 | 100 | 99.7 | 91.3 | 100 | 0 | 100 | 100 |
| 800 | 100 | 0 | 100 | 96.4 | 12.2 | 16.3 | 0 | 100 | 100 |
| | 500 | 65.1 | 100 | 99.1 | 63.8 | 24.5 | 0 | 100 | 100 |
| | 1000 | 87.4 | 100 | 99.7 | 81.2 | 100 | 0 | 100 | 100 |
| 1100 | 100 | 50.9 | 100 | 90.9 | 0 | 0 | 0 | 100 | 100 |
| | 500 | 94.8 | 100 | 99.1 | 29.0 | 0 | 0 | 100 | 100 |
| | 1000 | 98.9 | 100 | 100.0 | 77.1 | 0 | 0 | 100 | 100 |

Note that Al, Mg and Ca not converted to HF (and oxides or sulfates) appear as solid fluorides, $AlF_3$, $CaF_2$ or $MgF_2$ are removed from the system in the calcine by separation from the hot off-gases comprising HF, HCl and other unconverted volatile fluorides and chlorides. In contradistinction, Si, Ti and Fe not converted to acid are the gaseous $SiF_2$, $TiF_4$ and $FeF_3$ which leave with the off-gas and are recycled with the acids, and these elements can produce acid (and oxides or sulfates) on subsequent passes.

When the non-Si-containing concentrated liquor is the source of the feed material for the pyrohydrolysis mixed acids regeneration, the operating conditions differ. Water vapor is typically present in an amount equal to at least about four (4) times the stoichiometric amount necessary to produce hydrogen halides from substantially all of the halide present in said aqueous solution. Additionally, appropriate temperatures are typically from about 500° C. to about 1000° C., with the preferred temperature at about 700° C.

The $SO_2$ present during the simultaneous or contemporaneous pyrohydrolysis and sulfation may be derived from a wide variety of sources. Sulfur dioxide gas may simply be added to the system. Alternatively, $SO_2$ may be formed in situ by oxidation of sulfur which may itself derive from numerous sources. In general, virtually any sulfur-containing material which can be oxidized to $SO_2$ at the pyrohydrolysis/sulfation temperature will suffice and may be added to the system. Alternatively, $H_2SO_4$ or any other sulfur-containing material which breaks down to $SO_2$ may be used.

Pyrite and/or other sulfur-containing minerals are contaminants in coal. Although such minerals are removed during coal cleaning processes, they provide a ready source of sulfur for the regeneration process. Such minerals from other parts of a coal cleaning process or elsewhere and/or other sulfur sources may simply be introduced into the pyrohydrolyzer/sulfation reactor. Whenever the above described forms of sulfur are introduced, $SO_2$ is formed in situ by oxidation of the sulfur in the presence of oxygen. Additionally, the sulfur bound in the organic structure of the coal (or other hydrocarbon) used to supply heat for the pyrohydrolysis/sulfation reactions, provides useful sulfur for the sulfation reactions.

As indicated hereinabove and shown in equations viii through x, sulfation requires oxygen and water as well as $SO_2$. In addition, oxygen is consumed by oxidation of coal and/or by materials present in the coal which oxidize at the pyrohydrolysis/sulfation conditions. Accordingly,. oxygen should be present in an amount at least equal to and preferably greater than the amount needed for both the extraneous oxidations and the sulfation of the Ca, Na and K. For purposes of the present invention, an excess of $O_2$ is defined as an amount above at least the minimum of $O_2$ required.

The sulfation of the alkali and alkaline earth metals (except for Mg), i.e. K, Na and Ca, is virtually complete provided sufficient excess $SO_2$, $H_2O$ and $O_2$ are present. The percent excess of sulfur should preferably be sufficient to give approximately 0.50 percent $SO_2$ in the off-gas stream (typically 40% to 80% excess sulfur). The percent excess combustion air should preferably be sufficient to give approximately 0.10 percent $O_2$ in the off-gas stream (typically 4% to 7% excess combustion air).

Heat for the reactions may be supplied by combusting any hydrocarbon, such as coal, coal refuse, or even oil or gas. Slimes, i.e. fines, carried in with the spent acid feed liquor may also provide part of the required heat as does oxidation of sulfurous material, typically pyrite.

As needed, inexpensive reagents such as calcium fluoride and sodium chloride can be added to the pyrohydrolysis/sulfation as halide make-up reagents to balance any losses which may occur. Sulfuric acid may similarly be used as a sulfur make-up reagent where pyrite from the coal or other sources proves insufficient in quantity for sulfation purposes.

Two advantages to the pyrohydrolysis/sulfation method for recovery of the mixed acids are: (1) the waste product is a benign calcine (ash) comprised principally of oxides, sulfates, and MgF and constitutes a minimal problem for disposal and (2) the HF/HCl product is purified by passing through the vapor state as compared to alternative regeneration schemes which have only an aqueous recycle stream in which certain elements, not completely eliminated from the circuit, build up to the point where they are deleterious to the usefulness of the regenerate product, e.g. contaminants in HCl or HF used for leaching coal and other ores may inhibit leaching.

The calcine formed in the pyrohydrolyzer/sulfation unit, constituting the metal sulfates, oxides, and a small quantity of magnesium fluoride which is quite insoluble, is an environmentally acceptable waste easily disposed of. Before the calcine disposal, the $Al_2O_3$ may be recovered from the calcine and recycled for use in precipitating the Si present in the aqueous feed solution. The off-gas separated from the calcine, constituting both the HF and HCl gases, water vapor, and combustion gases, is advantageously directed to a heat exchanger wherein steam is recovered for general use or to pre-evaporate the incoming liquor. After heat recovery, the acid gases may advantageously be adiabatically absorbed in an aqueous stream or otherwise reconstituted for use, e.g. in a coal cleaning process. The combustion gases, containing traces of acid gases are scrubbed with a lime scrubber. After the lime in the lime scrubber is spent, e.g. converted to $CaF_2$ and $CaCl_2$ by reaction of the the HF and HCl traces with the lime, it may advantageously be recycled to and undergo pyrohydrolysis/-sulfation for recovery of the HF and HCl.

Pyrite Removal

Gravity (including tabling) or other physical, including physio-chemical, separations are facilitated by the removal of virtually all non-pyritic (aluminosilicate and other non-sulfides) mineral matter according to the leach steps of the present invention. This is due to the fact that both coal and pyrite move toward their natural specific gravities, about 1.3 and 5.2, respectively, as aluminosilicate (specific gravity 2.6) and other non-sulfides locked to coal and pyrite are dissolved away. The large differences in the specific gravities, magnetic susceptibilities, surface properties, etc. of coal and pyrite solids after mixed HF and HCl leaching for mineral matter removal are examples of material differences in physical properties which may be used to effect a separation between pyrite and coal. For purposes of the present invention, pyrite is physically separated from the coal either by gravity separation techniques known in the art or by magnetic separation. Such physical separation is possible because the upstream process according to the present invention chemically liberates the pyrite by dissolution of the aluminosilicate and other non-sulfides encasing the pyrite.

Washing

Washing the coal product to remove dissolved cations and anions can be advantageously effected by any number of systems and washes. Typically, a multiple (four) stage countercurrent decantation (CCD) system with minimum water addition may be used. The CCD circuit may optionally be operated in conjunction with filters and/or centrifuges. In such a system, retention time in the CCD circuit is about thirty hours during which there is adequate diffusion of halogens from the coal product. In addition to long-term washing with water, as in a multistage CCD circuit, additional halogen removal can also be effected by addition of various compounds such as acetic acid, nitric acid, alcohol (90% ethanol, 5% methanol and 5% isopropyl) and ammonium hydroxide, and by heating to below boiling the water or solutions described above or by thermal treatment described below.

The coal product of the present invention has fast thickening and filtration rates as compared to conventional coal slurries, due to the absence of clays and coal slimes or fines which have been removed upstream.

Heat Treatment

As an alternative or in addition to washing, the coal product may be treated for example, thermally treated by baking to a temperature below about that of incipient loss of hydrocarbon volatiles, typically from about 225° to about 400° C., preferably about 300° to 350° C., for a sufficient time, e.g. to achieve halogen removal to less than about ½ percent by weight. The upper temperature is in large part determined by a desire to avoid loss of hydrocarbon value through driving off low volatilizing components. As will be understood by those skilled, in the art, removal of halogen volatiles can be effected by use of a sweep gas, typically an inert gas such as $N_2$, passing over the coal during heating. It has been discovered that addition of $H_2O$ as water vapor to the sweep gas, i.e. in comparison to $N_2$, $CO_2$, and the like, results in enhanced halogen removal. It has further been discovered that addition of ammonia, both with and without water vapor, similarly results in unexpectedly enhanced halogen removal. Accordingly, two additional embodiments of the present invention include improved methods of removing halogen as volatile halides from coal and/or leached coal product comprising heating to a temperature of from about 225° C. to about 400° C., preferably from about 300° C. to about 350° C., to drive off volatile halides, such as $SiF_4$ from the breakdown of residual fluorosilicic acid; $TiF_4$ by sublimation; $NH_4Cl$ formed by reaction of $NH_3$, water and HCl adsorbed on the coal by sublimation, and removing said volatile halides with a sweep gas comprising steam and/or ammonia.

FIG. 1 depicts a schematic of an integrated coal cleaning process according to the present invention using Western coal as feed. Referring to FIG. 1, typical Western coal containing a high moisture content is heated to substantially reduce the inherent water content prior to crushing or sizing to about 1" or less. In some instances sizing to less than about 10 mm, preferably less than about 5 mm and most preferably to approximately ½ mm may beneficially effect downstream process steps. Crushing or sizing may be by any means whereby the desired size feed particles are obtained.

The sized coal feed 2, is subjected to a HCl acid pre-leach 100. Generally, conditions for the pre-leach are 1 to 20 weight percent HCl, more preferably 5 to 10 weight percent HCl. This weak hydrochloric acid leach at ambient temperature and pressure removes the high calcium and magnesium (calcite and dolomite) content prior to the HF/HCl leaching 104. The spent HCl leach liquor 3 and the acid-leached coal feed 5 are separated in liquid/solid separation 4 with the spent liquor 3 advancing to the acid pre-leach regeneration circuit 200 for regeneration of the HCl acid by methods and at conditions known in the art, e.g. pyrohydrolysis. The coal feed advances to a washing step 102, and then to the mixed acids leach step 104 where it is subjected to a mixed acids leach comprising less than about 70 weight percent HF and less than about 38 weight percent HCl, primarily for removal of all mineral matter except sulfides (non-sulfide mineral matter). In certain preferred embodiments the mixed acid leach is carried out with the following initial acid concentrations: HF between about 5 and about 70 percent by weight and the HCl between about 3 and about 38 percent by weight; more preferably with an HF concentration of from about 10 to about 40 percent by weight and an HCl concentration of from about 5 to about 20 percent by weight. The leach is efficient for removing non-sulfide mineral matter thereby chemically liberating coal and pyrite over a wide range of temperatures (ambient to below boiling). The leaching may be co- or countercurrent, and a preferred condition is countercurrent with the first stage near ambient temperatures (10° to 35° C.) and the second stage hot (35° to 90° C.) and the leaching is at atmospheric pressure. Each of the first and second stages extends for a period of time of from about 0.5 to about 5.0 hours. After each stage of leaching a solid/liquid separation is made and the pregnant mixed acids leachate, i.e. liquor, from the first stage advantageously advances to the mixed acids regeneration circuit while the partially spent acid, i.e. liquor, from the second stage advances to the first stage leach.

The mixed acid leach slurry 7 comprising spent mixed acid 9 and leached coal 11 and coal fines 12 goes to liquid/solid separation II 106, where the coal product 11 is separated from the spent acid 9 and coal fines 12. The spent acid 9 and fines 12 advance to mixed acid regeneration circuit. HF and HCl leached solids advance to washing II 108 and then to the pyrite removal step 110.

The mixed acids regeneration 109 is by pyrohydrolysis/sulfation. The separated spent liquor 9 will contain Si which may optionally be removed from said spent liquor 9 in Si removal 120. One method for removing the Si generally comprises contacting the liquor with an aluminum oxide-rich material containing about 30% by weight $Al_2O_3$. The $Al_2O_3$ will react to form a $SiO_2$ precipitate and a non-Si-containing liquor. In exchange for removing Si as $SiO_2$ from the liquor, Al is put into solution from $Al_2O_3$ (or $Al(OH)_3$) as $AlF_3$; the $AlF_3$ can be readily pyrohydrolyzed to recover the HF and produce $Al_2O_3$ (which may be recycled). The chemical equation is:

$$Al_2O_3 + H_2SiF_6 \rightarrow H_2O + 2AlF_3 + SiO_2 \quad \text{(xiv)}$$

The non-Si liquor 121 is then pre-heated/pre-concentrated 130 by direct (per FIG. 1) or indirect heating from the HF/HCl-containing hot off-gas stream from the pyrohydrolyzer to produce a concentrated non-Si liquor 118 and water vapor 117. The concentrated non-Si-containing liquor 118 from the preconcentrator 130, is directed to a fluid bed reactor or other suitable reactor for the mixed acids regeneration 109. In one procedure, the concentrate is sprayed into the high temperature reactor and contacted with a hot combustion gas, sulfur as $SO_2$, oxygen, and water vapor. When Si is not present in the concentrated feed solution, the operating parameters are typically: temperatures from about 500° C. to about 1000° C., with the preferred temperature from about 600° C. to about 900° C., more particularly at about 700° C. The amount of water vapor needed is four (4) times the stoichiometric excess required for the pyrohydrolysis and sulfation of all metal halides present. The pyrohydrolysis and sulfation step will form a calcine 150, comprising the metal oxides and sulfates, and hot off-gases 119, including HF and HCl. The hot off-gases 119 are used for pre-heating/pre-evaporating 130 the incoming spent mixed acids leach liquor 121.

The calcine-free off-gases 119 and water vapor 117 are directed to an absorber 160 where the HF and HCl may be adiabatically absorbed and form an aqueous mixed HF/HCl acid 151 for use in the mixed acids leach 104. The combustion gases 152 contained in the off-gases are directed to a lime scrubber 170 to remove contaminants and impurities. The reacted lime slurry from the scrubbers 171 generally contains fluorine as $CaF_2$ and chlorine as $CaCl_2$ which can be introduced into the pyrohydrolyzer for recovery of the halides. As will be understood by those skilled in the art, an overall process such as depicted and described will vent any operation from which chloride or fluoride fumes may emanate. The gases collected from said venting will be passed through a lime scrubber usually nearby to remove chlorides and fluorides. As before, slurry containing $CaF_2$ and $CaCl_2$ will be recycled through the pyrohydrolyzer/sulfation system 109.

Figure 2:
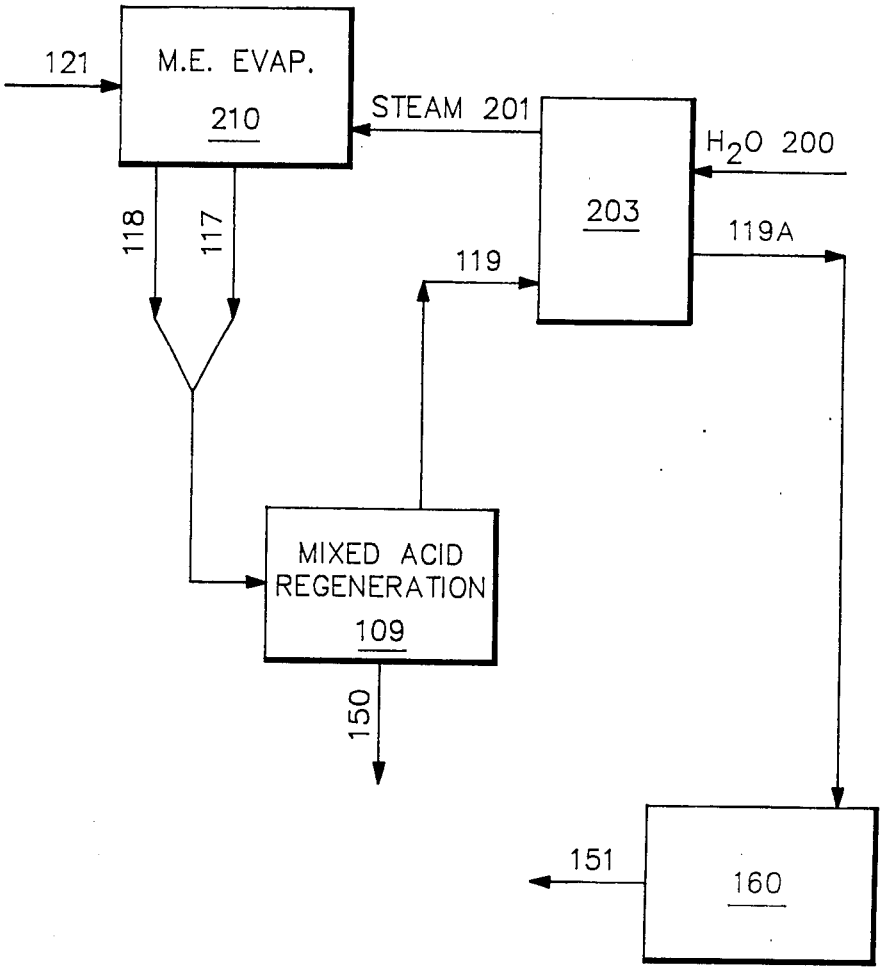
FIG. 2 is a schematic flow diagram of an alternative embodiment of the mixed acid regeneration.

Alternatively referring to FIG. 2, where the Si present in the spent mixed acids leach is not removed, the spent leach is indirectly, rather than directly pre-heated/pre-evaporated by the hot off-gases from the pyrohydrolyzer. In this method, the hot off-gases 119 heat water 200 to form steam 201 in a heat exchanger 203. The steam 201 then indirectly heats the spent liquor 121 in a multiple effect evaporator 210. Both the water vapor 117 and the concentrated spent liquor 118 formed by this pre-heating step are introduced into the fluid bed or other reactor and contacted with a hot combustion gas, sulfur as $SO_2$, oxygen and water vapor for the mixed acids regeneration 109. When Si is present in the spent mixed acid leach, the operating conditions for regeneration are typically: temperatures from about 600° C. to about 1100° C., with the preferred temperature in the range of 750° C. to 900° C., more particularly about 800° C. The amount of water vapor needed is at least equal to about ten (10) times the stoichiometric amount of water required to convert all metal halides present to their oxides or sulfates, and Si conversion greater than 80%. The hot off-gas 119, containing the regenerated HF and HCl, heats water for the indirect pre-heat/pre-evaporation step. The off-gas 119A is then directed to an absorber 160 where the HF and HCl may be adiabatically absorbed to form the aqueous mixed acids 151. The regenerated aqueous mixed acids 151 are then recycled to the mixed acids leach step 104. The calcine 150 formed, comprising metal oxides and sulfates, are separated from the hot off-gases 119A and environmentally disposed of.

Practice of the method of the present invention comprising (a) contacting coal, preferably comminuted to a size of about 1 inch or less, with a mixed acid leach liquor comprising less than about 70 weight percent HF and less than about 38 weight percent HCl at atmospheric pressure and at a temperature below the mixed acid boiling point, preferably at ambient temperature, to produce a spent liquor and leached coal and (b) separating said spent liquor from said leached coal results in unexpected efficient contaminant liberation and removal. In particular, an excess of about 85–90% of the alkali metals present are removed, typically 99% or more of the Na, Li and K present in Western coal is removed. In addition, liberation of pyrite is substantially complete allowing effective separation without loss of coal.

Referring again to FIG. 1, the coal solids 11 obtained by liquid/solid separation 106 following the mixed acids leach 104 and washing 108 will still contain the pyrite originally present in the coal feed. The pyrite 14 is thus separated from the solids 11 by any means of physical (gravity or other) separation 110, such as tabling. The resulting coal solids 16 are substantially free of pyrite.

The leached coal solids 11 undergo washing II 108 before pyrite removal and heat treatment to further remove volatile halides, i.e. anion and cation contaminants including residual $Si^{4+}$, $Al^{3+}$, $Ti^{4+}$, $Cl^-$ and $F^-$ ions and moisture. In a preferred embodiment the coal solids 11 are washed 108 in a four (more or less) stage countercurrent decantation (CCD) system. The inherently long retention time of the CCD system provides ample time for diffusion of $Cl^-$ and $F^-$ ions. Hot water is more effective than cold, however, this is an economic trade off of operating versus capital cost.

In another preferred embodiment the pyrite-free coal solids 16 undergo thermal treatment 114 by heating the solids to a temperature of incipient devolatilization. The thermal treatment 114 is accomplished by heating to a temperature of from about 300° C. to 350° C. for a time sufficient to remove any halogens present to an amount below about ½ percent by weight. Fluid bed or other equipment known to those skilled in the art may be employed. During the heating step 114 it is useful to move a gas over or through the leached solids to remove any evolved halogens or moisture. Gases suitable for this include nitrogen, carbon dioxide and/or flue gas. As indicated hereinbefore, another aspect of the present invention resides in the improved results (in terms of halogen removal) obtained when the sweep gas further contains $NH_3$ and/or water vapor. Advantageously, the volatile halides 18 from heat treatment 114 are scrubbed in scrubber 170 or other scrubber with the lime slurry 171 advancing to the mixed acid regeneration 109.

The following Examples are provided by way of illustration and not by way of limitation.

EXAMPLE 1

To assess the effect of various acid mixtures and temperatures on the removal of non-sulfide mineral matter, the following experiment was was made:

A sample of raw Western U.S. sub-bituminous coal from the Absaloka mine in Montana was prepared by crushing and sizing to minus 28-mesh. For calcium and magnesium reduction, feed to the mixed acids tests was prepared by first leaching a sample of the coal in 10 percent by weight HCl for 2 hours at 10 percent by weight solids and ambient temperature with solids suspension by stirring. After leaching the solids were washed with deionized (DI) water.

Five mixed acid tests were done at ambient temperature and five at 90° C. The acid concentrations used (same for both temperatures) were:

| | Acid Concentrations for Five Tests | | | | |
|---|---|---|---|---|---|
| | 1 | 2 | 3 | 4 | 5 |
| Hydrofluoric Acid % | 40 | 30 | 20 | 10 | 0 |
| Hydrochloric Acid % | 0 | 5 | 10 | 15 | 20 |

The series allows assessment of the effect of only HF and only HCl. All leaching tests were done at 10 percent by weight solids and agitated by stirring. Results are in Table 2.

TABLE 2

Mixed Acids (Hf and HCL) Leaching Tests
Conditions and Results

| CONDITIONS[1] | | | | | RESULTS (dry basis) | | | | | |
|---|---|---|---|---|---|---|---|---|---|---|
| | | Acid Conc. | | | | Pyrite | Ash Analysis, % in Ash | | | |
| Test No. | Material | HF % | HCl % | Temp., °C. | Ash % | Sulfur, % | $SiO_2$ % | $Al_2O_3$ % | $TiO_2$ % | $Fe_2O_3$ % |
| — | Raw Feed (to HCl preleach) | — | — | — | 13.4 | 0.37 | 36.51 | 14.98 | 0.71 | 6.35 |
| 424-1 | HCl preleached product[3] | — | — | — | 8.51 | 0.45 | 58.11 | 23.81 | 1.24 | 8.79 |
| 424-2 | Mixed Acid leached product | 40 | 0 | Ambient | 1.15 | 0.42 | 3.88 | 3.23 | 2.19 | 62.93 |
| 424-3 | Mixed Acid leached product | 30 | 5 | Ambient | 1.15 | 0.46 | 2.56 | 2.92 | 2.42 | 65.08 |
| 424-4 | Mixed Acid leached product | 20 | 10 | Ambient | 1.15 | 0.46 | 3.15 | 2.96 | 2.77 | 65.10 |
| 424-5 | Mixed Acid leached product | 10 | 15 | Ambient | 1.23 | 0.41 | 12.53 | 3.06 | 3.18 | 61.50 |
| 424-6 | Mixed Acid leached product | 0 | 20 | Ambient | 8.40 | 0.36 | 59.32 | 23.48 | 1.10 | 8.48 |
| 360 | HCl preleached product[3] | — | — | — | 8.29 | 0.30 | 57.34 | 23.64 | 1.14 | 9.16 |
| 361 | Mixed Acid leached product | 40 | 0 | 90 | 1.74 | 0.60 | 3.49 | 6.66 | 0.37 | 57.28 |
| 362 | Mixed Acid leached product | 30 | 5 | 90 | 1.24 | 0.41 | 2.23 | 11.44 | 0.29 | 56.67 |
| 363 | Mixed Acid leached product | 20 | 10 | 90 | 1.04 | 0.57 | 3.01 | 9.68 | 0.54 | 67.79 |
| 364 | Mixed Acid leached product | 10 | 15 | 90 | 1.57 | 0.30 | 1.78 | 7.30 | 0.54 | 66.40 |

TABLE 2-continued

| Mixed Acids (Hf and HCL) Leaching Tests Conditions and Results | | | | | | | | | | |
|---|---|---|---|---|---|---|---|---|---|---|
| 365 | Mixed Acid leached product | 0 | 20 | 90 | 6.30 | 0.38 | 71.31 | 14.50 | 1.34 | 9.92 |
| CONDITIONS[1] | | | | | RESULTS (dry basis) | | | | | |
| | | Acid Conc. | | | Ash Analysis, % in Ash | | | | | |
| Test No. | Material | HF % | HCl % | Temp., °C. | CaO % | MgO % | $Na_2O$ % | $K_2O$ % | $P_2O_5$ % | $SO_3$ % |
| — | Raw Feed (to HCl preleach) | — | — | — | 22.81 | 2.36 | 3.37 | 0.50 | 1.33 | 13.6 |
| 424-1 | HCl preleached product[3] | — | — | — | 1.71 | 1.06 | 0.1 | 1.8 | 0.36 | 1.04 |
| 424-2 | Mixed Acid leached prodct | 40 | 0 | Ambient | 6.61 | 1.56 | 0.1 | 0.05 | 1.12 | 10.70 |
| 424-3 | Mixed Acid leached product | 30 | 5 | Ambient | 7.04 | 1.41 | 0.3 | 0.05 | 1.06 | 9.10 |
| 424-4 | Mixed Acid leached product | 20 | 10 | Ambient | 6.17 | 1.38 | 0.4 | 0.1 | 1.01 | 10.40 |
| 424-5 | Mixed Acid leached product | 10 | 15 | Ambient | 5.75 | 1.17 | 0.2 | 0.05 | 0.55 | 9.16 |
| 424-6 | Mixed Acid leached product | 0 | 20 | Ambient | 0.94 | 0.96 | 0.2 | 1.9 | 0.01 | 0.99 |
| 360 | HCl preleached product[3] | — | — | — | 1.52 | 0.61 | 0.3 | 1.8 | 0.32 | 1.49 |
| 361 | Mixed Acid leached product | 40 | 0 | 90 | 9.33 | 3.38 | 0.3 | 0.2 | 0.152 | 17.0 |
| 362 | Mixed Acid leached product | 30 | 5 | 90 | 9.35 | 4.96 | 0.4 | 0.3 | 0.081 | 17.1 |
| 363 | Mixed Acid leached product | 20 | 10 | 90 | 8.24 | 4.43 | 0.2 | 0.2 | 0.067 | 14.9 |
| 364 | Mixed Acid leached product | 10 | 15 | 90 | 5.01 | 2.58 | 0.1 | 0.8 | 0.053 | 10.6 |
| 365 | Mixed Acid leached product | 0 | 20 | 90 | 0.74 | 0.61 | 0.1 | 1.3 | 0.018 | 0.36 |

[1]Mixed acid leaching done at 10% solids, 4 hours, agitation by stirring; after solid liquid separation, solids washed with 5 displacements of DI water.
[2]Western sub-bituminous coal, Absaloka mine, 28-mesh by zero.
[3]Pre-leached with 10% HCl, 10% solids, 20–25° C., 2 hr., agitated by stirring, after solid liquid separation solids washed 5 times with DI water.

EXAMPLE 2

To assess the potential for removing additional mineral matter from mixed acid leached coal by gravity means, a sample from the previous example, test 366 was sink/float separated in a heavy liquid with a specific gravity of 1.6. The analyses of feed and products are given in Table 3.

TABLE 3

| Removal of Mineral Matter by Gravity Separations after Mixed Acid Leaching (Analyses on Dry Basis) | | | |
|---|---|---|---|
| | Yield Wt % | Ash, % | Pyritic Sulfur, % |
| Feed[1] to Sink-Float | 100.0 | 1.04 | 0.33 |
| 1.60 Float, Clean Coal | 97.9 | 0.37 | 0.06 |
| 1.60 Sink, Refuse | 2.1 | 35.22[2] | 12.9[2] |

[1]Product from mixed acid leaching test; conditions for leaching were:
a. Feed 28-mesh by zero raw Western coal from the Absaloka mine.
b. Pre HCl leach, 10% HCl, 10% solids, ambient temperature, 2 hours, agitation by stirring.
c. Mixed acid leach, 20% HF and 10% HCl, 10% solids, 4 hours, 90° C., agitation by stirring.
d. Solid/liquid separation and washing of solids with DI water after step b and c.
[2]Calculated, not analytical values.

EXAMPLE 3

A series of experiments were conducted wherein process parameters were varied in order to assess the effect of each parameter on the removal of non-sulfide minerals from coal. In addition, the raw feed was varied from Eastern bituminous coal from a composite comprising 85% from the Cedar Grove and 15% upper Stockton-Lewiston seams in Boon County, West Virginia to Western sub-bituminous coal from the Absaloka mine in Montana.

Table 4 lists the process parameters investigated in this test series. Specific test conditions and test results are summarized in Tables 5 through 11.

TABLE 4

| Test # | Coal[1] Rank | Pre-Dry | HCl Preleach % HCl | Mixed Acid Leach % HF/% HCl | Slimes Removed | Wash | Sink/Float or Table | Bake |
|---|---|---|---|---|---|---|---|---|
| 1 | Bit | No | No | 20/20 | Yes | No | No | Yes |
| 2 | Bit | No | 10 | 20/15 | No | Yes | No | Yes |
| 3 | Bit | No | 10 | 20/15 | During Tabling | Yes | Table | Yes |
| 4 | Sub | No | 10 | 20/20 | No | Yes | No | Yes |
| 5 | Sub | Yes | 10 | 20/20 | Yes | Yes | No | Yes |
| 6 | Sub | No | 10 | 15/20 | No | Yes | S/F | No |
| 7 | Sub | No | 10 | 20/15 | During Tabling | Yes | Table | Yes |

[1]Bit = Bituminous
Sub = Sub-bituminous

TABLE 5

| Test #1 Bituminous - No Preleach - Slimes Removed | | | |
|---|---|---|---|
| | Feed Coal Raw Eastern 28 M × 0 | 600-3 Mixed Acid Leach[1] 20% HF, 20% HCl 28 × 400 M | 600-4 Bake, 4 hr 325° C. with water vapor 28 × 400 M |
| Coal | | | |
| Ash, % | 5.85 | 1.17 | 0.58 |
| Total S, % | 0.75 | 0.80 | 0.81 |
| Pyritic S, % | 0.15 | 0.14 | 0.12 |
| Chlorine, ppm | 1785 | 12368 | 694 |
| Fluorine, ppm | 56 | 2311 | 788 |
| Vol Mat % | — | 32.32 | 31.57 |
| Oxides, ppm | | | |
| $SiO_2$ | 32058 | 4223 | 624 |
| $Al_2O_3$ | 17842 | 2562 | 1010 |
| $TiO_2$ | 947 | 793 | 707 |
| $Fe_2O_3$ | 3896 | 2000 | 1722 |
| CaO | 842 | 649 | 641 |
| MgO | 345 | 239 | 157 |

TABLE 5-continued

| Test #1 Bituminous - No Preleach - Slimes Removed | | | |
|---|---|---|---|
| | Feed Coal Raw | 600-3 Mixed Acid Leach[1] | 600-4 Bake, 4 hr 325° C. with |
| | Eastern 28 M × 0 | 20% HF, 20% HCl 28 × 400 M | water vapor 28 × 400 M |
| $Na_2O$ | 353 | 200 | 72 |
| $K_2O$ | 900 | 276 | 14 |
| $P_2O_5$ | 63 | 25 | 17 |
| BaO | 18 | 55 | 38 |
| $SO_3$ | 819 | 107 | 303 |

[1]Mixed acid leach conditions: ambient temp, 4 hr, 30% solids.

TABLE 6

| Test #2 Bituminous, Preleached | | | | | |
|---|---|---|---|---|---|
| Analyses | Feed Coal Raw Eastern 28 M × 0 | 396-2 10% HCl Preleach 2 hr, 90° C. 30% solids | 396-4 Mixed Acid Leach[1] 20% HF, 15% HCl | 396-6 Long Term Wash & Dry 90° C. | 396-7 Bake, 4 hr, 325° C. with water vapor |
| Coal | | | | | |
| Ash, % | 5.85 | 5.58 | — | 0.51 | 0.48 |
| Total S, % | 0.75 | 0.75 | — | 0.75 | 0.81 |
| Pyritic S, % | 0.15 | 0.15 | — | 0.13 | 0.13 |
| Chlorine, ppm | 1785 | 7080 | 13298 | 9923 | 872 |
| Fluorine, ppm | 56 | 25 | 4968 | 1265 | 458 |
| Vol Mat, % | — | — | — | 33.41 | 30.54 |
| Oxides, ppm | | | | | |
| $SiO_2$ | 32058 | 31973 | | 428 | 295 |
| $Al_2O_3$ | 17842 | 17409 | | 800 | 718 |
| $TiO_2$ | 947 | 943 | | 708 | 714 |
| $Fe_2O_3$ | 3896 | 2265 | | 1504 | 1633 |
| CaO | 842 | 426 | | 401 | 455 |
| MgO | 345 | 234 | | 72 | 78 |
| $Na_2O$ | 353 | 249 | | 93 | 56 |
| $K_2O$ | 900 | 797 | | 28 | 13 |
| $P_2O_5$ | 63 | 45 | | 15 | 15 |
| BaO | 18 | 16 | | 33 | 31 |
| $SO_3$ | 819 | 424 | | 561 | 478 |

[1]Mixed acid leach conditions: ambient temp, 4 hr, 30% solids.

TABLE 7

| Test #3 Pilot Plant Run - 160 lbs. Eastern Bituminous | | | | | |
|---|---|---|---|---|---|
| | Feed Coal Raw Eastern 28 M × 0 (no pre-screen) | 10% HCl Preleach 2 hr; 75° C. 30% Solids[2] | Mixed Acid Leach[3] followed by Long Term Wash[4] | Tabling and Desliming at about 400 mesh | Bake - 2 hrs. 350° C., with water vapor + $N_2$[5] |
| Coal[1] | | | | | |
| Ash % | 5.73 | 6.05 | 0.60 | 0.58 | 0.61 |
| Total S, % | 0.76 | 0175 | 0.78 | 0.77 | 0.77 |
| Pyritic S, % | 0.17 | 0.17 | 0.19 | 0.16 | 0.17 |
| Chlorine, ppm | 1791 | — | 10558 | 9464 | 1181 |
| Chlorine, ppm | 50 | — | 4471 | 2057 | 918 |
| Vol. Mat. % | — | | | | |
| Oxides, ppm | | | | | |
| $SiO_2$ | 30426 | 34364 | 383 | 360 | 756 |
| $Al_2O_3$ | 17247 | 18876 | 1152 | 928 | 994 |
| $TiO_2$ | 888 | 998 | 762 | 800 | 956 |
| $Fe_2O_3$ | 3845 | 2408 | 1512 | 1317 | 1275 |
| CaO | 917 | 442 | 493 | 519 | 594 |
| MgO | 418 | 315 | 178 | 181 | 145 |
| $Na_2O$ | 332 | 284 | 107 | 107 | 105 |
| $K_2O$ | 768 | 835 | 31 | 29 | 44 |
| $P_2O_5$ | 46 | 54 | 25 | 39 | 29 |
| BaO | 63 | 42 | 35 | 38 | 37 |
| $SO_3$ | 923 | 266 | 840 | 963 | 836 |

[1]All analysis on a dry basis.
[2]Filtered and washed with 2 displacement washes.
[3]Mixed acid leach oonditions: 20% HF, 15% HCl ambient temp; 4 hrs, 30% solids followed by 2 displacement washes.
[4]30% solids, deionized water, ambient temp = 27° C. for 24 hours.
[5]6" diameter glass reactor; 10 SCFM of $N_2$ + $H_2O$, 20% $H_2O$ by volume.

TABLE 8

| Analyses | Feed, Bag #3 Raw Western 28 M × 0 | Test #4 Sub-bituminous As Received: 602-2 10% HCl Preleach 2 hr, 90° C. 30% solids | 602-4 Mixed Acid Leach[1] 20% HF, 15% HCl | 602-6 Long Term Wash & Dry 90° C. | 602-7 Bake, 4 hr, 325° C. with water vapor |
|---|---|---|---|---|---|
| Coal | | | | | |
| Ash, % | 13.86 | 8.92 | — | 0.67 | 0.95 |
| Total S, % | 0.92 | — | — | 0.92 | 1.05 |
| Pyritic S, % | 0.42 | — | — | 0.36 | 0.19 |
| Chlorine, ppm | 108 | 3644 | 4240 | 691 | 136 |
| Fluorine, ppm | 67 | — | 1365 | 293 | 187 |
| Vol Mat, % | — | — | — | 40.97 | 34.77 |
| Oxides, ppm | | | | | |
| $SiO_2$ | 48094 | 60789 | | 231 | 275 |
| $Al_2O_3$ | 21760 | 20917 | | 255 | 257 |
| $TiO_2$ | 968 | 1052 | | 257 | 254 |
| $Fe_2O_3$ | 6999 | 5985 | | 4645 | 7007 |
| CaO | 29799 | 570 | | 335 | 370 |
| MgO | 2772 | 660 | | 59 | 65 |
| $Na_2O$ | 4365 | 78 | | 5 | 7 |
| $K_2O$ | 1413 | 1632 | | 2 | 1 |
| $P_2O_5$ | 460 | 32 | | 8 | 8 |
| BaO | 788 | 240 | | 102 | 157 |
| $SO_3$ | 17740 | 446 | | 408 | 502 |

[1]Mixed acid leach conditions: ambient temp, 4 hr, 30% solids.

TABLE 9

| Analyses | Feed[1] Raw Western 28 M × 0 | Test #5 Sub-bituminous, Pre-Dried, Slimes Removed (28 × 400-Mesh): 398-2 10% HCl Preleach 2 hr, 90° C. 30% solids | 398-4 Mixed Acid Leach[2] 20% HF, 15% HCl | 398-6 Long Term Wash & Dry 90° C. | 398-7 Bake, 4 hr, 325° C. with water vapor |
|---|---|---|---|---|---|
| Coal | | | | | |
| Ash, % | 14.24 | 5.21 | — | 0.84 | 0.91 |
| Total S, % | 0.93 | 0.92 | — | 1.04 | 1.02 |
| Pyritic S, % | 0.43 | 0.38 | — | 0.40 | 0.40 |
| Chlorine, ppm | 105 | 758 | 5397 | 815 | 129 |
| Fluorine, ppm | 68 | — | 1088 | 297 | 155 |
| Vol Mat, % | — | — | — | 41.35 | 34.88 |
| Oxides, ppm | | | | | |
| $SiO_2$ | 51548 | 29749 | | 278 | 220 |
| $Al_2O_3$ | 23211 | 12660 | | 197 | 191 |
| $TiO_2$ | 1028 | 791 | | 152 | 151 |
| $Fe_2O_3$ | 6820 | 6095 | | 6025 | 6941 |
| CaO | 29761 | 1073 | | 472 | 462 |
| MgO | 2961 | 135 | | 70 | 68 |
| $Na_2O$ | 4357 | 368 | | 5 | 6 |
| $K_2O$ | 1680 | 273 | | 8 | 7 |
| $P_2O_5$ | 498 | 47 | | 7 | 7 |
| BaO | 744 | 352 | | 211 | 239 |
| $SO_3$ | 24492 | 1026 | | 601 | 688 |

[1]Although actual feed to the test was 28 × 400 M, only analyses of 28 M × 0 coal were available. The 28 M × 0 coal contained 10% −400 M material.
[2]Mixed acid leach conditions: ambient temp, 4 hr, 30% solids.

TABLE 10

| Analyses | Feed Coal Raw Western 28 M × 0 | Test #6 Sink Float Separation of Sub-bituminous Leach Products: 10% HCl Preleach 2 hr, amb temp, 10% Solids | Mixed Acids Leach[1] 15% HF, 20% HCl | S/F Separation Product[2] |
|---|---|---|---|---|
| Coal | | | | |
| Ash, % | 13.54 | 7.56 | 1.11 | 0.37 |
| Total S, % | 1.04 | 0.86 | 1.02 | 0.53 |
| Pyritic S, % | 0.58 | 0.38 | 0.34 | 0.05 |
| Oxides, ppm | | | | |
| $SiO_2$ | 44573 | 44755 | 1172 | 622 |
| $Al_2O_3$ | 21068 | 18748 | 516 | 290 |

TABLE 10-continued

| Analyses | Feed Coal Raw Western 28 M × 0 | Test #6 Sink Float Separation of Sub-bituminous Leach Products: 10% HCl Preleach 2 hr, amb temp, 10% Solids | Mixed Acids Leach[1] 15% HF, 20% HCl | S/F Separation Product[2] |
|---|---|---|---|---|
| $TiO_2$ | 1015 | 854 | 319 | 229 |
| $Fe_2O_3$ | 8178 | 6448 | 6133 | 832 |
| CaO | 31304 | 748 | 777 | 648 |
| MgO | 3154 | 317 | 154 | 81 |
| $Na_2O$ | 4982 | 83 | 22 | 8 |
| $K_2O$ | 1678 | 1186 | 25 | 9 |
| $P_2O_5$ | 392 | 257 | 71 | 56 |

TABLE 10-continued

| Analyses | Feed Coal Raw Western 28 M × 0 | 10% HCl Preleach 2 hr, amb temp, 10% Solids | Mixed Acids Leach[1] 15% HF, 20% HCl | S/F Separation Product[2] |
|---|---|---|---|---|
| BaO | 812 | 574 | 591 | 24 |
| $SO_3$ | 19768 | 544 | 1110 | 781 |

Test #6
Sink Float Separation of Sub-bituminous Leach Products

[1]Leach description: Feed - Raw Western coal, minus 28-mesh × 0. Preleach - 10% HCl, 2 hr, ambient temperature, 10% solids. Mixed acid leach - Acid conc. as shown, 4 hr, ambient temperature, 30% solids. Long term wash - 2 deonized $H_2O$ reslurries - 8 hrs and 16 hrs. Dry - 90° C.
[2]1.42 Specific gravity float, 94.42 wt. % floated.

carbons and Western, sub-bituminous cleaned carbon samples.

The Ulan sample was produced by an HF leach followed by an 18-hour wash and tabling. After receipt from Australia, the 3-mm×0.1-mm sample was rinsed with deionized water and dried at 90° C. The fluorine content of this sample was 5636 ppm and the volatile matter was 33.61% (both on a dry basis).

The Western coal cleaned carbon sample was produced by a three-stage sequential leach of 28-mesh×0, raw coal from the Powder River Basin in Montana. The chlorine and fluorine contents of this sample were 1617 ppm and 118 ppm, respectively.

Baking tests were completed in fluid bed reactors (FBR's).

TABLE 11

Test #7
Pilot Plant Run - 80 lbs. Western Sub-bituminous

| | Feed Coal Raw Eastern 28 M × 0 (no pre-screen) | 10% HCl Preleach 2 hr; 75° C. 30% Solids[2] | Mixed Acid Leach[3] followed by Long Term Wash[4] | Tabling and Desliming at about 400 mesh | Bake - 2 hrs. 325° C., with water vapor + $N_2$[5] |
|---|---|---|---|---|---|
| Coal[1] | | | | | |
| Ash % | 13.54 | 8.00 | 0.56 | 0.37 | 0.41 |
| Total S, % | 1.00 | 1.15 | 0.73 | 0.62 | 0.53 |
| Pyritic S, % | 0.59 | 0.48 | 0.27 | 0.15 | 0.11 |
| Chlorine, ppm | 123 | — | 8247 | 3454 | 542 |
| Chlorine, ppm | 62 | — | 2807 | 1266 | 336 |
| Vol. Mat. % | — | | | | |
| Oxides, ppm | | | | | |
| $SiO_2$ | 43734 | 44640 | 558 | 485 | 902 |
| $Al_2O_3$ | 20310 | 17760 | 435 | 233 | 245 |
| $TiO_2$ | 934 | 952 | 254 | 257 | 285 |
| $Fe_2O_3$ | 7501 | 9200 | 2727 | 1232 | 1234 |
| CaO | 29517 | 672 | 509 | 518 | 558 |
| MgO | 2898 | 464 | 120 | 77 | 85 |
| $Na_2O$ | 4482 | 104 | 24 | 18 | 19 |
| $K_2O$ | 1340 | 1176 | 10 | 7 | 7 |
| $P_2O_5$ | 420 | 48 | 57 | 190 | 79 |
| BaO | 677 | 456 | 39 | 26 | 18 |
| $SO_3$ | 21390 | 792 | 902 | 596 | 422 |

[1]All analysis on a dry basis.
[2]Filtered and washed, 2 displacement washes.
[3]Mixed acid leach conditions: 20% HF, 15% HCl ambient temp; 4 hrs, 30% solids followed by 2 × displacement wash.
[4]30% solids, distilled wter, 24 hrs at ambient temperature of 27° C.
[5]Lab test - 5 cm. diameter glass reactor; 2.6 l/m $N_2$ + $H_2O$, 30% water vapor by volume.

EXAMPLE 4

A series of tests were designed to test the effectiveness of heat treatment for removal of residual halogens, chlorine and fluorine, from coal solids after the acid leaches. Tests were conducted with both Ulan cleaned Test conditions and results are summarized in Table 12.

TABLE 12

Halogen Removal by Heat Treatment - Summary of Conditions and Results

| Run No. | FBR[1] | Anaylsis, ppm F | Anaylsis, ppm Cl | Sweep Gas Type | Flow Rate scfm | Oper. Temp °C. | Product Sample Analyses, ppm - Fluorine or (Chlorine) Time at Temperature, hr[2] 0 | 0.5 | 1.0 | 1.5 | 2.0 | 2.5 | 3.0 | 3.5 | 4.0 | 4.0 | 5.0 |
|---|---|---|---|---|---|---|---|---|---|---|---|---|---|---|---|---|---|
| 1 | 4" | 5,636 | — | $N_2$ | 3 | 300 | 1051 | 876 | 754 | 676 | 653 | 620 | 620 | 605 | 563 | — | — |
| 2 | 4" | 5,636 | — | $N_2$ | 3 | 300 | 1162 | 833 | 745 | — | 673 | — | 588 | 545 | — | — | 498 |
| 3 | 6" | 2,747 | — | $N_2$ | 10 | 300 | 890 | — | — | 567 | — | — | — | — | — | — | — |
| 4 | 6" | — | — | $N_2$ | 10 | 325 | 507 | — | 414 | — | 357 | — | — | — | — | — | — |
| 5 | 6" | — | — | $N_2$ | 10 | 350 | 357 | 253 | 243 | — | 243 | — | — | — | — | — | — |
| 6 | 4" | 2,747 | — | $N_2$ | 3 | 350 | 429 | 275 | 256 | 299 | 236 | 210 | 200 | — | — | — | — |
| 7 | 4" | 2,747 | — | $CO_2$ | 3 | 350 | 429 | 275 | 256 | 229 | 236 | 210 | 200 | — | — | — | — |
| 8 | 6" | 5,636 | — | $N_2$ | 10 | 300-350 | 1185 | 624 | 381 | 355 | 317 | 255 | 270 | — | — | — | — |
| 9 | 6" | 5,636 | — | $N_2$ | 10 | 300-350 | 623 | 475 | 170 | 148 | 134 | 105 | 112 | — | — | — | — |
| | | | | Steam | 2.4 | | | | | | | | | | | | |
| 10 | 6" | 118 | 1,617 | $N_2$ | 10 | 325 | (558) | (331) | (232) | (176) | (171) | (132) | — | — | — | — | — |
| | | | | Steam | 2.2 | | | | | | | | | | | | |

[1]FBR = fluid-bed reactor.
[2]Times for Runs 8 and 9 are approximate.
All Tests on Ulan coal (Australia) except No. 10 which is sub-bituminous coal from Western U.S.

EXAMPLE 5

A test was conducted to determine the effect of $NH_3$ on the removal of halogens during heat treatment. A batch sample of Eastern coal was processed to produce cleaned carbons.

The purged carbons were produced from Eastern, 2-inch by 0 coal obtained from Westmoreland Coal Company's Hampton 3 preparation plant. The cleaned coal is a blend of two seams from Boone County, West Virginia: 85% Cedar Grove and 15% Stockton-Lewiston. The coal was processed according to the following steps:

1. Leach 1: 10% HCl, 75°C., 2 hours, 30% solids, two deionized water washes on the filter.
2. Leach 2: 20% HF, 15% HCl, ambient temperature, 4 hours, 30% solids, one deionized water wash on the filter.
3. Long term wash: ambient temperature, 18 hours, 30% solids in deionized $H_2O$.
4. Wet tabling: only the clean coal product was baked.
5. Drying: forced-air oven, 60° C., 48 hours.

After drying, the purged carbons were baked in a 6-inch diameter, Pyrex glass fluid-bed reactor (FBR) at 325° C. The fluidizing medium was approximately 10 scfm nitrogen containing about 20% water. Water was introduced into the nitrogen gas stream before the gas preheater and vaporized in the preheater. Purged carbons were fed continuously to the FBR at a rate of 25 grams per minute to provide a residence time of about two hours in the 3000-gram capacity bed. Material was withdrawn periodically via a bed overflow port, weighed, and analyzed for chlorine and fluorine.

Prior to baking, the purged carbons contained 10350 ppm chlorine and 2240 ppm fluorine. At one point in the baking test the chlorine and fluorine in a baked sample were analyzed at 1721 and 874 ppm, respectively. Ammonium hydroxide was then added to the water entering the preheater to produce a concentration of 0.1% $NH_3$. A comparison of the halogen concentrations before and after ammonia addition is shown below in Table 13.

TABLE 13

| | Cl, ppm | F, ppm | N, % |
|---|---|---|---|
| Sample 1 (before $NH_3$ addition) | 1721 | 874 | 1.50 |
| Sample 2 (after $NH_3$ addition) | 1327 | 832 | 1.54 |

EXAMPLE 6

Regeneration of HF/HCl was accomplished according to the present inventin from a feed solution having the following composition:

| Element | grams/liter |
|---|---|
| F | 162 |
| Cl | 111 |
| Si* | 40.3 |
| Al | 10.3 |
| Fe | 5.41 |
| Ca | 0.34 |
| Na | 0.10 |
| Mg | 0.22 |
| K | 0.30 |
| Ti | 0.083 |
| P | 0.13 |

*present as fluorosilicic acid.

The feed solution was heated to remove water and fluorosilic acid to produce and aqueous feed of the following assay:

| Item | Assay |
|---|---|
| F | 47.3% |
| Si | 0.43% |
| Salts | 30.8 grams/liter |

A 4 gram sample of the evaporated salt solution was placed in two containers and inserted into an electric furnace. The reactor (muffel) temperature was 800° C., reaction time was 1.5 hours and the nitrogen and water flow rates were 100 ml/min and 0.5 ml/min, respectively.

The percent conversion of halide salts was 97.3%; the results are provided in Table 14.

TABLE 14

| Time min | $H_2O$ ml(cum) | ml/min | Off-Gases mg F/min | Off-Gases g F(cum) | Remarks |
|---|---|---|---|---|---|
| 10 | 3.9 | .39 | 63 | .68 | Some off-gases leaked due to high pressure bursts. |
| 20 | 8.7 | .48 | 86 | 1.55 | |
| 30 | 13.9 | .52 | 5.0 | 1.59 | |
| 40 | 19.2 | .53 | 2.1 | 1.61 | |
| 50 | 24.5 | .53 | 1.2 | 1.62 | |
| 60 | 29.4 | .49 | .77 | 1.63 | |
| 70 | 34.4 | .50 | .45 | 1.64 | |
| 80 | 39.3 | .49 | .25 | 1.64 | |
| 90 | 44.2 | .49 | .17 | 1.64 | |

| | Assay, % Wt. g | F | g F | Distribution % F |
|---|---|---|---|---|
| Feed (evap salts) | 4.00 | 47.3 | | |
| Off-gases | | | 1.64 | 97.3 |
| Calcine | 2.18 | 2.11 | 0.046 | 2.7 |

EXAMPLE 7

The procedure of Example 6 was followed with $H_2SO_4$ in a concentration of 31 gm/liter and flowrate of 0.48 ml/min in lieu of the water flowrate. Percent conversion obtained was 98.8%. The results are provided in Table 15.

TABLE 15

| Time min | 31 g/l $H_2SO_4$ ml(cum) | ml/min | Off-Gases mg F/min | Off-Gases g F(cum) |
|---|---|---|---|---|
| 10 | 1.9 | .19 | 46 | 0.58 |
| 20 | 6.3 | .44 | 104 | 1.62 |
| 30 | 11.1 | .48 | 10 | 1.72 |
| 40 | 16.0 | .49 | 2.0 | 1.74 |
| 60 | 25.6 | .48 | 0.50 | 1.75 |
| 70 | 30.5 | .49 | 0.25 | 1.76 |
| 80 | 34.9 | .44 | 0.16 | 1.76 |
| 90 | 40.2 | .53 | 0.10 | 1.76 |

| | Assay, % Wt. g | F | g F | Distribution % F |
|---|---|---|---|---|
| Feed (evap salts) | 4.00 | 47.3 | | |
| Off-gases | | | 1.76 | 98.8 |
| Calcine | 2.22 | 0.99 | 0.022 | 1.2 |

The difference between silica-free feeds and those containing silica is substantial. Comparison of process parameters for feeds identical except for the presence of silica is provided in Table A.

TABLE A

| | Feed Liquor with Si | Feed Liquor without Si |
|---|---|---|
| Reactor Temperature, °C. | 800° | 700° |
| Feed Liquor Feed Rate, lbs/hr | 551,775 | 234,283 |

TABLE A-continued

| | Feed Liquor with Si | Feed Liquor without Si |
|---|---|---|
| Feed Composition (lbs/hr) | | |
| HCl (Free) | 20,800 | 20,800 |
| HF (Free) | 21,000 | 21,000 |
| $H_2SiF_6$ | 62,010 | — |
| $AlF_3$ | 21,205 | 21,205 |
| $FeF_3$ | 5,200 | 5,200 |
| $CaF_2$ | 35,200 | 35,200 |
| NaF | 2,000 | 2,000 |
| Excess Water over Stiochiometric, % | 970 | 600 |
| Air Rate, lbs/hour | 689,871 | 207,871 |
| Fuel Rate (coal, slimes & pyrite, MM Btu/hr | 791.2 | 211.6 |
| Conversions of halide to acid, % | | |
| $AlF_3$ | 100 | 100 |
| $SiF_4$ | 79 | — |
| $FeF_3$ | 92 | 90 |
| $CaF_2$ | 100 | 100 |
| NaF | 100 | 100 |
| Relative Reactor Size (cross sectional area) | 100 | 36 |

EXAMPLE 8

Sink-float tests were conducted which examined the effects of leaching on the cleaning characteristics of coal. Two coal samples were sink-floated: minus 28-mesh raw Westmoreland coal (Absaloka Mine) and the HCl/HF leached coal from Test 260. Each sample was sink-floated in organic liquids at the following gravities: 1.30, 1.40, 1.50, 1.80, 2.10, and 2.96. Two 10-gram samples of the raw coal and two 5-gram samples of the leached coal were separated at each gravity. The amount of leached coal used was limited to sample availability. The 48 resulting products were dried, weighed, and analyzed for ash content. Averaged weight distributions of the sink and float products at each gravity are given in Table 16.

TABLE 16

Centrifuge Sink-Float Results (Westmoreland Coal, Absaloka Mine)

| | Specific Gravity | | Direct | Cumulative Wt %[4] | |
|---|---|---|---|---|---|
| | Sink | Float | Wt %[2] | Float | Sink |
| Raw, 28 M × 0 | | 1.30 | 0.5 | 0.5 | 100.0 |
| coal Test 262 | 1.30 | 1.40 | 64.0 | 64.5 | 99.5 |
| | 1.40 | 1.50 | 16.8 | 81.3 | 35.5 |
| | 1.50 | 1.80 | 8.5 | 89.8 | 18.7 |
| | 1.80 | 2.10 | 0.4 | 90.2 | 10.2 |
| | 2.10 | 2.96 | 7.1 | 97.3 | 9.8 |
| | 2.96 | | 2.7 | 100.0 | 2.7 |
| Purged Carbons | | 1.30 | 7.1 | 7.1 | 100.0 |
| Test 263[1] | 1.30 | 1.40 | 75.4 | 82.5 | 92.9 |
| | 1.40 | 1.50 | 13.0 | 95.5[3] (95.7) | 17.5 |
| | 1.50 | 1.80 | 0 | 95.5[3] (97 2) | 4.5[3] (4.3) |
| | 1.80 | 2.10 | 0 | 95.5[3] (95.6) | 4.5[3] (2.8) |
| | 2.10 | 2.96 | 0 | 95.5[3] (95.3) | 4.5[3] (4.4) |
| | 2.96 | | 4.5 | 100.0 | 4.5[3] (4.7) |

[1]2-stage leach conditions (Test 260, large-scale batch leach)
1. 10% HCl, 10% solids, ambient temperature, 2 hr, 5 displacement washes.
2. 20% HF, 10% solids, ambient temperature, 4 hr, 5 displacement washes plus 18 hr long-term wash.
[2]Calculated from cumulative data.
[3]Estimate based on an average of actual data in parentheses, excluding suspect values of 97.2% float and 2.8% sink.
[4]Each number represents the average of two values.

Although the foregoing invention has been described in some detail by way of illustration and example for purposes of clarity of understanding, it will be obvious that certain changes and modifications may be practiced within the scope of the invention, as limited only by the scope of the appended claims.

What is claimed is:

1. A method of producing a coal product from coal and coal derivatives, said coal product having a mineral matter content of less than about 5 percent by weight comprising the steps of, (a) contacting coal of a size less than about an inch with a mixed acid leach liquor comprising less than about 70 weight percent hydrofluoric acid and less than about 38 weight percent hydrochloric acid at atmospheric pressure and a temperature below the boiling point of the acid mixture to produce a spent acid liquor and leached coal; and (b) separating said leached coal and said spent acid liquor.

2. A method according to claim 1 further comprising regenerating said mixed acid leach liquor from said spent acid liquor.

3. A method of producing a coal product from coal and coal derivatives, said coal product having a mineral matter content of less than about 5 percent by weight comprising the steps of:

(a) contacting coal of a size less than about one inch with a mixed acid leach liquor comprising less than about 70 weight percent hydrofluoric acid and less than about 38 weight percent hydrochloric acid at atmospheric pressure and at a temperature below the boiling point of the acid mixture to produce a leached coal and a spent acid liquor comprising at least one metal halide wherein said metal halide will pyrohydrolyze to its metal oxide at a temperature below about 1200° C. and at atmospheric pressure and at least one metal halide that will not pyrohydrolyze to metal oxide at said temperature and pressure, but will sulfate to form its metal sulfate at said temperature and pressure, and wherein said halide is selected from the group consisting of fluoride and chloride;

(b) separating said spent mixed acid leach liquor and said leached coal;

(c) contacting said spent mixed acid leach liquor with a hot gas comprising water vapor in the presence of $SO_2$ and excess oxygen at a temperature of from about 600° C. to about 1100° C. to regenerate HF and HCl from substantially all of the metal halide salts present and to form the respective metal sulfates and oxides;

(d) separating said HF and HCl as part of hot off-gas produced in step (c) from the oxide/sulfate-containing calcine formed in step (c);

(e) recycling said regenerated HF and HCl mixed acids to mixed acid leach of step (a); and (f) removing pyrite from said leached coal to produce a coal product substantially free of pyrite.

4. A method according to claim 1 or 3 wherein said coal product is comminuted to a size less than about 5 mm.

5. A method according to claim 2 wherein said coal is comminuted to a size less than about ½ mm.

6. A method according to claim 1 or 3 further comprising pre-leaching said coal with a hydrochloric acid leach prior to step (a), wherein said acid leach comprises from about 1 to about 20 percent by weight hydrochloric acid and wherein said hydrochloric acid leach is at a temperature of about 40° C. to form a pre-leached coal and spent HCl leach liquor.

7. A method according to claim 6 wherein said spent HCl leach liquor and said pre-leached coal are separated.

8. A method according to claim 7 wherein said spent HCl leach liquor undergoes pyrohydrolysis by contact with a hot gas comprising water vapor in the presence of $SO_2$ and excess oxygen at elevated temperature and ambient pressure for a time sufficient to regenerate the HCl acid.

9. A method according to claim 8 wherein said spent hydrochloric acid contains coal fines and further comprising supplying fuel for said pyrohydrolysis at least partially with said fines.

10. A method according to claim 8 wherein said regenerated HCl acid is recycled to the hydrochloric pre-leach step.

11. A method according to claim 8 wherein said pre-leached coal is washed and wherein said washing is sufficient to remove calcium in said coal to a level below about 1000 ppm;

12. A method according to claim 1 or 3 wherein said mixed acid leach liquor step (a) comprises less than about 20 percent by weight hydrochloric acid.

13. A method according to claim 1 or 3 wherein said mixed acid leach liquor comprises less than about 40 percent by weight hydrofluoric acid.

14. A method according to claim 1 or 3 wherein said contacting of step (a) is done in a plurality of stages.

15. A method according to claim 14 wherein said contacting in the first stage is at a temperature from about 10° C. to about 35° C.

16. A method according to claim 14 wherein said contacting in the second stage is at a temperature from about 35° C. to about 90° C.

17. A method according to claim 1 or 3 wherein said contacting of step (a) in each stage is for a time period sufficient to solubilize substantially all of the mineral matter and the total time is from about 0.5 to about 5 hours.

18. A method according to claim 14 wherein said contacting further comprises counter-current leaching.

19. A method according to claim 14 wherein said contacting comprises co-current leaching.

20. A method according to claim 3 further comprising contacting in the presence of a sulfur-containing material and wherein said hot gas comprises oxygen and said $SO_2$ is formed in situ by oxidation of said sulfur.

21. A method according to claim 20 wherein said sulfur-containing material is pyrite.

22. A method according to claim 3 wherein said $SO_2$ of step (c) is obtained from contacting in the presence of sulfuric acid.

23. A method according to claim 3 wherein said spent mixed acid leach liquor contains Si, said method further comprising pre-heating said liquor by indirect heat exchange in a multiple effect evaporator with steam heated by hot off-gases from step (c) in an indirect heat exchange boiler prior to said contacting of step (c).

24. A method according to claim 3 wherein said spent mixed acid leach liquor contains Si and wherein said water vapor of step (c) is present in an amount equal to at least about 10 times the necessary stoichiometric amount.

25. A method according to claim 3 wherein any Si present in said spent mixed acid leach liquor of step (b) is removed from said spent mixed acid leach liquor to become substantially non-Si-containing prior to said contacting of step (c).

26. A method according to claim 25 further comprising pre-heating said non-Si-containing spent mixed acid leach liquor by directly contacting said liquor with the hot off-gases from step (c) to form a concentrated liquor and water vapor.

27. A method according to claim 26 wherein said concentrated liquor is contacted with said hot gas of step (c) to regenerate said HF and HCl.

28. A method according to claim 3 wherein said hot gas of step (c) is the product of hydrocarbon combustion.

29. A method according to claim 3 wherein said spent mixed acid leach liquor separated in step (b) contains coal fines and further comprising regenerating said mixed acid leach liquor in a pyrohydrolyzer fired at least in part by said coal fines.

30. A method according to claim 3 wherein the ratio of HF and HCl in said mixture to be regenerated of step (c) is predetermined and further comprising adding NaCl and $CaF_2$ as halogen make-up reagents in sufficient quantity to achieve said ratio.

31. A method according to claim 30 wherein said ratio is that of the HF/HCl in step (a).

32. A method according to claim 3 wherein said separation of step (f) is physical gravity separation.

33. A method according to claim 3 wherein said separation of step (f) is physical magnetic separation.

34. A method according to claim 3 further comprising:

(g) treating said coal product to remove halogens.

35. A method according to claim 34 wherein said treating of step (g) comprises heating to a temperature of from about 225° C. to about 400° C. for a time sufficient to remove said halogens as volatile halides.

36. A method according to claim 34 wherein said treating of step (g) comprises washing at a temperature less than boiling with a wash selected from the group consisting of water, acetic acid, alcohol, ammonium hydroxide, nitric acid and mixtures thereof.

37. A method according to claim 3 wherein said spent mixed acid leach liquor comprises halides of Na, Ca, K, Si, Mg, Fe, Al, Ti, and P.

38. A method of producing a coal product from coal and coal derivatives, said coal product having a mineral matter content of less than about 1 percent by weight comprising the steps of:

(a) contacting coal of a size less than about one inch with a mixed acid leach liquor comprising less than about 70 weight percent hydrofluoric acid and less than about 38 weight percent hydrochloric acid at atmospheric pressure and at a temperature below the boiling point of the acid mixture to produce a leached coal and a spent acid liquor comprising at least one metal halide wherein said metal halide will pyrohydrolyze to its metal oxide at a temperature below about 1200° C. and at atmospheric pressure and at least one metal halide that will not pyrohydrolyze to metal oxide at said temperature and pressure, but will sulfate to form its metal sulfate at said temperature and pressure, and wherein said halide is selected from the group consisting of fluoride and chloride;

(b) separating said spent mixed acid leach liquor and said leached coal;

(c) contacting said spent mixed acid leach liquor with a hot gas comprising water vapor in the presence of $SO_2$ and excess oxygen at a temperature of from about 600° C. to about 1100° C. to regenerate HF and HCl from substantially all of the metal halide salts present and to form the respective metal sulfates and oxides;

(d) separating said HF and HCl as part of hot off-gas produced in step (c) from the oxide/sulfate-containing calcine formed in step (c);

(e) recycling said regenerated HF and HCl mixed acids to mixed acid leach of step (a);

(f) removing pyrite from said leached coal to produce a coal product substantially free of pyrite; and (g) treating the coal product to remove halogens.

39. A method of cleaning coal comprising:

(a) leaching said coal with a mixture of HF and HCl to produce cleaned coal and a spent acid liquor containing Al and Fe and at least one metal halide selected from the group consisting of Ca, K, and Na halides;

(b) separating said coal from said spent liquor;

(c) removing Si from said spent acid liquor;

(d) contacting said liquor in the presence of $SO_2$ and oxygen with a hot gas comprising water vapor in an amount in stoichiometric excess of the $H_2O$ necessary to produce HF/HCl from all of the fluoride and chloride present at a temperature of from about 500° C. to about 1100° C. and under reaction conditions selected to regenerate HF and HCl from substantially all of the metal halide salts present and to form an environmentally acceptable residue comprising the oxides of Al and Fe and the sulfates of the group consisting of Ca, K, and Na; and (e) recycling said HF and HCl to the leaching of step (a).

40. A method of cleaning coal comprising:

(a) leaching said coal with a mixture of HF and HCl to produce cleaned coal and a spent acid liquor containing Si and at least one metal halide selected from the group consisting of alkaline earth and alkali metal halides which will not pyrohydrolyze to its oxides, but will form its sulfate in the presence of $SO_2$, $O_2$ and $H_2O$, at temperatures below about 1200° C.;

(b) separating said coal from said spent liquor;

(c) contacting said liquor in the presence of $SO_2$ and oxygen with a hot gas comprising water vapor in an amount in stoichiometric excess of the $H_2O$ necessary to produce HF/HCl from all of the fluoride and chloride present, at a temperature of from about 600° C. to about 1100° C. and under reaction conditions selected to regenerate HF and HCl from substantially all of the metal halide salts present and to form an environmentally acceptable residue; and (d) recycling said HF and HCl to the leaching of step (a).

* * * * *